US011685174B2

(12) United States Patent
Sakagami et al.

(10) Patent No.: US 11,685,174 B2
(45) Date of Patent: Jun. 27, 2023

(54) POST-PROCESSING DEVICE AND PRINTING SYSTEM

(71) Applicant: Seiko Epson Corporation, Tokyo (JP)

(72) Inventors: Shota Sakagami, Matsumoto (JP); Yusaku Amano, Matsumoto (JP); Yu Tsumuraya, Matsumoto (JP); Isao Momose, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/646,834

(22) Filed: Jan. 3, 2022

(65) Prior Publication Data

US 2022/0126609 A1 Apr. 28, 2022

Related U.S. Application Data

(63) Continuation of application No. 17/078,994, filed on Oct. 23, 2020, now Pat. No. 11,254,145.

(30) Foreign Application Priority Data

Oct. 24, 2019 (JP) ..... 2019-193296

(51) Int. Cl.
*B41J 11/58* (2006.01)

(52) U.S. Cl.
CPC ..... *B41J 11/58* (2013.01)

(58) Field of Classification Search
CPC ..... B41J 11/58; B65H 31/00
USPC ..... 347/104, 105, 106; 270/58.28, 58.13, 270/58.19
See application file for complete search history.

(56) References Cited

U.S. PATENT DOCUMENTS

| | | | | |
|---|---|---|---|---|
| 7,798,481 | B2 * | 9/2010 | Terao | B65H 31/10 270/58.11 |
| 10,821,753 | B2 | 11/2020 | Suzuki | |
| 10,828,925 | B2 | 11/2020 | Kubo et al. | |
| 2013/0113857 | A1 | 5/2013 | Armbruster et al. | |
| 2016/0378047 | A1 | 12/2016 | Tokuma | |
| 2019/0248168 | A1 * | 8/2019 | Kubo | G03G 15/6544 |

FOREIGN PATENT DOCUMENTS

| | | | | |
|---|---|---|---|---|
| CN | 106276377 | | 1/2017 | |
| CN | 106276377 | A * | 1/2017 | B65H 29/14 |
| JP | 2009-249080 | | 10/2009 | |
| JP | 2010111477 | A * | 5/2010 | B65H 29/125 |

* cited by examiner

*Primary Examiner* — Leslie A Nicholson, III
(74) *Attorney, Agent, or Firm* — Workman Nydegger

(57) ABSTRACT

A post-processing device includes an intermediate tray on which a medium transported in a transport direction is placed, a discharge port through which the medium post-processed on the intermediate tray is discharged, a discharge tray which is disposed in a gravity direction with respect to the discharge port and on which the medium discharged from the discharge port is placed, and an elevating mechanism which elevates the discharge tray, in which the elevating mechanism can move the discharge tray to a first normal position and a first standby position positioned in a direction opposite to the gravity direction with respect to the first normal position, and moves the discharge tray to the first normal position or the first standby position according to an amount of ink before the medium comes in contact with the discharge tray or the medium previously placed on the discharge tray.

12 Claims, 6 Drawing Sheets

POST-PROCESSING DEVICE AND PRINTING SYSTEM

The present application is a continuation of U.S. patent application Ser. No. 17/078,994, filed Oct. 23, 2020, which claims priority to JP Patent Application No. 2019-193296, filed Oct. 24, 2019, the disclosures of which are hereby incorporated by reference herein in their entireties.

BACKGROUND

1. Technical Field

The present disclosure relates to a post-processing device and a printing system including the post-processing device.

2. Related Art

In the related art, a post-processing device (for example, JP-A-2009-249080) is known which includes an alignment tray (intermediate tray) that receives and aligns a sheet (medium) on which an image is formed in an image forming device, such as a copy machine or an ink jet printer and on which the medium is placed in a state of being aligned, and a post processing unit that performs post processing, such as stapling processing, on the medium placed on the intermediate tray.

In the post-processing device described in JP-A-2009-249080, the medium, which is aligned on the intermediate tray and on which the stapling processing is performed by the post processing unit, is discharged toward a loading tray (discharge tray) and is placed on the discharge tray. Further, the discharge tray is lowered according to the amount of the medium placed on the discharge tray.

When an ink jet printer is used as an image forming device, a rigidity of a medium, on which an image is recorded in such a way that ink is ejected, changes according to a state of the ink (a state in which the ink is dried) absorbed into the medium. Therefore, when the post-processing device described in JP-A-2009-249080 receives the medium, on which the image is formed in the ink jet printer, a medium, which has a large rigidity and is hardly deformed, and a medium, which has a small rigidity and is easily deformed, exist as the medium to be discharged to a discharge tray.

However, in the post-processing device described in JP-A-2009-249080, there is a problem in that the medium, which has the small rigidity and is easily deformed, is deformed in an unintended direction on the discharge tray, and the medium, which has the small rigidity and is easily deformed, is not properly placed on the discharge tray.

SUMMARY

According to an aspect of the present disclosure, there is provided a post-processing device configured to perform post processing on a medium on which recording is performed by a liquid ejecting portion, the post-processing device including an intermediate tray on which the medium transported in a transport direction is placed and aligned, a discharge port through which the medium post-processed on the intermediate tray is discharged, a discharge tray that is disposed in a gravity direction with respect to the discharge port and on which the medium discharged from the discharge port is placed, and an elevating mechanism that elevates the discharge tray, in which the elevating mechanism is configured to move the discharge tray to a first normal position and a first standby position positioned in a direction opposite to the gravity direction with respect to the first normal position, and to move the discharge tray to the first normal position or the first standby position according to an amount of liquid ejected from the liquid ejecting portion toward the medium before the medium comes in contact with the discharge tray or a medium previously placed on the discharge tray.

In the post-processing device, the medium may include a first region disposed on a downstream in the transport direction and a second region disposed on an upstream in the transport direction, and the elevating mechanism may move the discharge tray to the first normal position or the first standby position according to an amount of liquid ejected to the first region.

In the post-processing device, the elevating mechanism may change the first standby position or a second standby position of the discharge tray using a parameter which influences drying of the liquid in addition to the amount of liquid ejected from the liquid ejecting portion toward the medium, and the parameter which influences drying of the liquid may include at least one of a temperature of an environment, a humidity of the environment, a transport speed of the medium transported in the transport direction, and a stop time of the medium transported in the transport direction.

In the post-processing device, when the medium includes a first medium that is initially placed on the discharge tray and a second medium that is subsequently placed on the discharge tray and a frictional force that acts between the first medium and the second medium changes according to an amount of liquid ejected to the first medium, the elevating mechanism may change a height of the first standby position according to the amount of liquid ejected to the first medium at a spot where the first medium comes in contact with the second medium.

According to another aspect of the present disclosure, there is provided a post-processing device configured to perform post processing on a medium on which recording is performed by a liquid ejecting portion, the post-processing device including an intermediate tray on which the medium transported in a transport direction is placed, a discharge port through which the medium post-processed on the intermediate tray is discharged, a discharge tray that is disposed in a gravity direction with respect to the discharge port and on which the medium discharged from the discharge port is placed, and an elevating mechanism that elevates the discharge tray, in which the elevating mechanism is configured to move the discharge tray to a second normal position and a second standby position positioned in a direction opposite to the gravity direction with respect to the second normal position, and in which, when the medium includes a first medium that is initially placed on the discharge tray and a second medium that is subsequently placed on the discharge tray and a frictional force that acts between the first medium and the second medium changes according to an amount of liquid ejected to the first medium, the elevating mechanism moves the discharge tray to the second normal position or the second standby position according to the amount of liquid ejected to the first medium at a spot where the first medium comes in contact with the second medium before the second medium comes in contact with the first medium.

In the post-processing device, the liquid ejecting portion may eject the liquid to the medium based on print data, and the amount of liquid ejected from the liquid ejecting portion toward the medium may be acquired based on the print data.

In the post-processing device, the elevating mechanism may change the first standby position or a second standby position of the discharge tray using a parameters which influences deformation of the medium due to gravity in addition to the amount of liquid ejected from the liquid ejecting portion toward the medium, and the parameter which influences the deformation of the medium due to the gravity may include at least one of a length of the medium in the transport direction and the number of mediums to be post-processed on the intermediate tray.

In the post-processing device, when a downstream end of the medium in the transport direction is disposed on an outside of the discharge port in a state in which the medium is placed on the intermediate tray, the elevating mechanism may move a position of the discharge tray in the opposite direction at a stage before the medium is placed on the intermediate tray.

In the post-processing device, the elevating mechanism may lower the discharge tray that is raised in the opposite direction to an original position until an upstream end of the medium in the transport direction is discharged from the discharge port.

According to a still another aspect of the present disclosure, there is provided a printing system including a printing device including a liquid ejecting portion which ejects a liquid to a medium, and the post-processing device.

DESCRIPTION OF EXEMPLARY EMBODIMENTS

1. First Embodiment

1.1 Overview of Printing System

Figure 1:
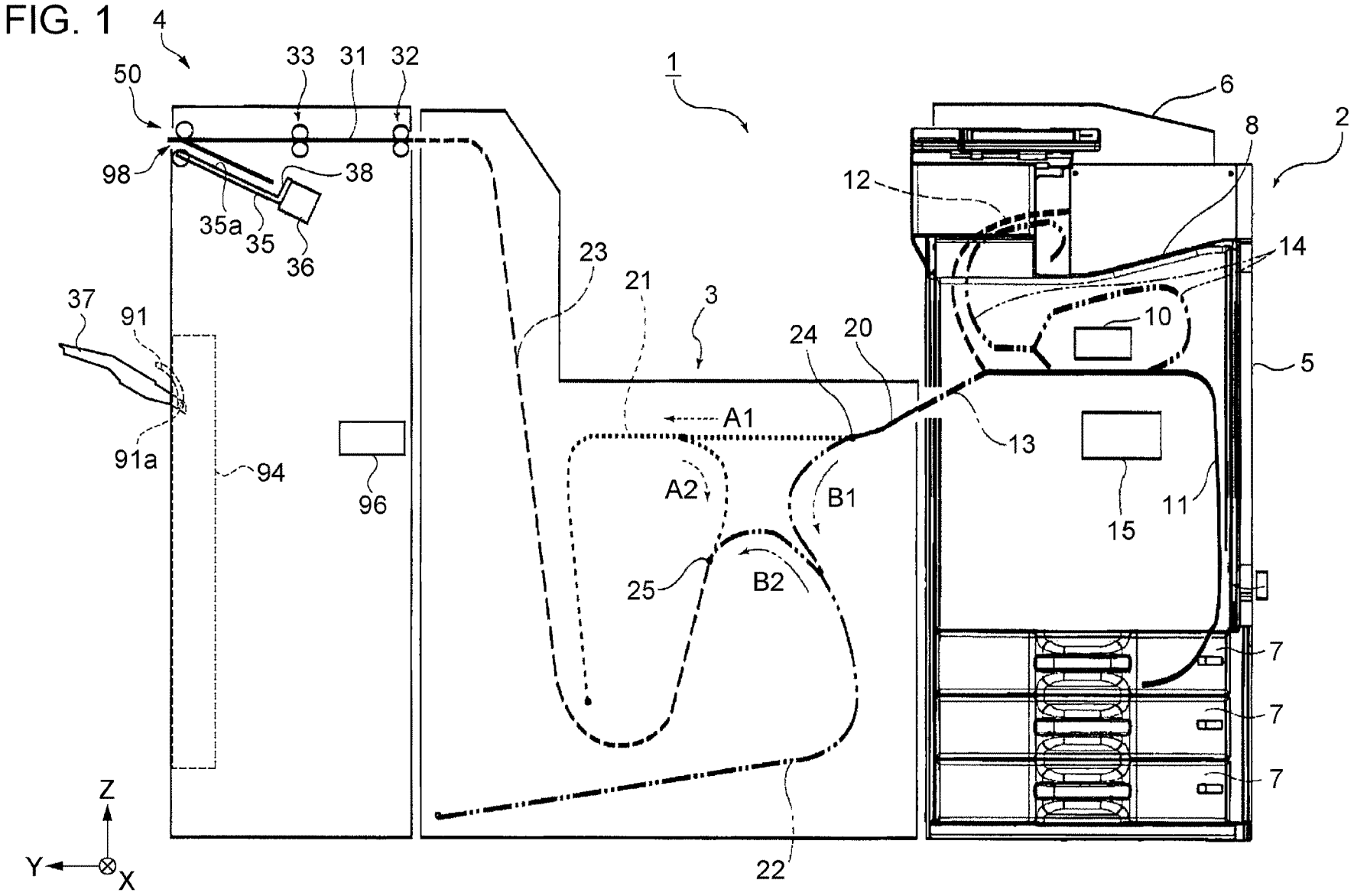
FIG. 1 is a schematic diagram of a printing system according to a first embodiment.
Figure 2:
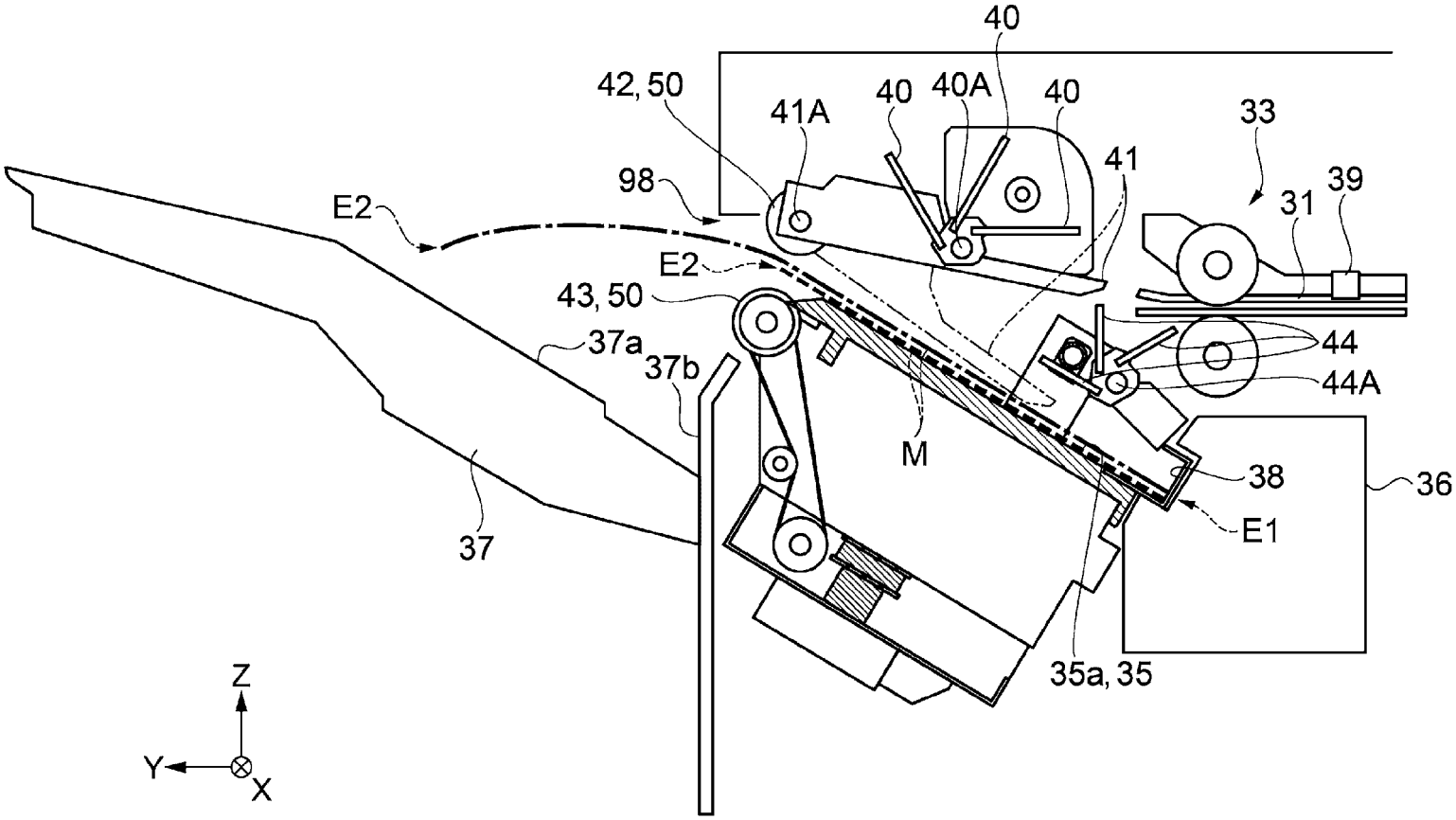
FIG. 2 is a side sectional view of a post-processing device according to the first embodiment.

FIG. 1 is a schematic diagram of a printing system 1 according to a first embodiment. FIG. 2 is a side sectional view of a post-processing device 4 according to the first embodiment.

First, an outline of the printing system 1 according to the present embodiment will be described with reference to FIG. 1.

As shown in FIG. 1, the printing system 1 includes a printing device 2, a transport device 3, and a post-processing device 4, and the printing device 2, the transport device 3, and the post-processing device 4 are sequentially disposed from a right side to face a left side of FIG. 1.

In the description below, it is assumed that a direction in which the printing device 2, the transport device 3, and the post-processing device 4 are disposed is a Y direction, a height direction of the printing system 1 is a Z direction, and a direction intersecting the Y direction and the Z direction is an X direction. The Y direction is a width direction of the printing system 1. The X direction is a depth direction of the printing system 1 and a width direction of a medium M (see FIG. 2). In addition, a tip side of an arrow indicating the direction is a + direction, and a base side of the arrow indicating the direction is a − direction.

Note that, a −Z direction is a gravity direction in the present application. A +Z direction is a direction opposite to the gravity direction in the present application.

The printing device 2 includes a line head 10 which is an example of a liquid ejecting portion that performs recording on the medium M. The transport device 3 receives the medium M on which an image is recorded from the printing device 2, and delivers the medium M to the post-processing device 4. The post-processing device 4 includes a processing portion 36 that executes predetermined post processing on the medium M placed on an intermediate tray 35.

The printing device 2, the transport device 3, and the post-processing device 4 are coupled to each other, and the medium M is transported from the printing device 2 toward the post-processing device 4.

The printing system 1 can input presence or absence of a recording operation or post processing performed on the medium M in the printing device 2, the transport device 3, and the post-processing device 4 from an operation panel which is not shown. The operation panel can be provided in the printing device 2 as an example.

Hereinafter, respective outlines of the printing device 2, the transport device 3, and the post-processing device 4 will be sequentially described.

The printing device 2 is configured as a multifunction peripheral that includes a printer portion 5 which includes the line head 10 for performing recording by ejecting ink, which is an example of a liquid, to the medium M, and a scanner portion 6. The printer portion 5 ejects ink from the line head 10 to the medium M to record a desired image on the medium M.

In the present embodiment, although the line head 10, which is attached to a device main body in a fixed state and ejects the ink to the medium M, is adopted as a head for performing the recording on the medium M, the present disclosure is not limited thereto, and printing may be performed using a serial head which ejects the ink to the medium M while moving in a width direction of the medium M.

A plurality of medium storage cassettes 7 are provided in a lower portion of the printing device 2. The medium M stored in the medium storage cassette 7 is sent to a recording region by the line head 10 through a feeding path 11 indicated by a solid line in FIG. 1, and thus the recording operation is performed. The medium M obtained after the recording is performed by the line head 10 is sent to any of a first discharge path 12 that is a path for discharging the medium M to a post-recording discharge tray 8 provided at an upper side of the line head 10, and a second discharge path 13 that is a path for sending the medium M to the transport device 3. In FIG. 1, the first discharge path 12 is indicated by a broken line, and the second discharge path 13 is indicated by a one-dot chain line.

In addition, the printing device 2 includes a reverse path 14 indicated by a two-dot chain line in the drawing to be configured to enable both-side recording in which, after performing the recording on a front surface of the medium M, the medium M is reversed, and the recording is performed on a back surface of the medium M. Also, in each of the feeding path 11, the first discharge path 12, the second discharge path 13, and the reverse path 14, a pair or more of transport rollers (not shown) are disposed as a unit that transports the medium M.

The printing device 2 includes a controller 15 that controls various operations of the printing device 2 and the transport device 3. The controller 15 includes hardware such as a Central Processing Unit (CPU), a Read Only Memory (ROM), and a Random Access Memory (RAM).

For example, the controller 15 acquires image data from an external computer (not shown) and generates print data. Further, the controller 15 controls the line head 10 based on the print data to record a predetermined image on the medium M.

The print data includes a print duty, a size of the medium M, a type of the medium M, and the like. The print duty is a ratio of the amount of liquid (the amount of ink) ejected to a print region of the medium M.

In addition, the controller 15 acquires a temperature of an environment and a humidity of the environment through a sensor (not shown) attached to the printing device 2.

The transport device 3 is disposed between the printing device 2 and the post-processing device 4, and is configured to receive the medium M, which is obtained after the recording is performed and is delivered from the second discharge path of the printing device 2, in a receiving path 20 to transport the medium M to the post-processing device 4. The receiving path 20 is indicated by a solid line in the drawing.

The transport device 3 includes two transport paths for transporting the medium M. A first transport path is a path through which the medium M is transported from the receiving path 20 to the discharge path 23 via a first switchback path 21. A second transport path is a path through which the medium M is transported from the receiving path 20 to the discharge path 23 through a second switchback path 22.

The first switchback path 21 is a path for receiving the medium M in a direction of an arrow A1 and, thereafter, switchback the medium M in a direction of an arrow A2. The second switchback path 22 is a path for receiving the medium M in a direction of an arrow B1 and, thereafter, switchback the medium M in a direction of an arrow B2.

The receiving path 20 branches into the first switchback path 21 and the second switchback path 22 at a branching portion 24. In addition, the first switchback path 21 and the second switchback path 22 converge at a convergence portion 25. Therefore, even when the medium M is sent from the receiving path 20 to any of the switchback paths, the medium M can be delivered to the post-processing device 4 from the common discharge path 23.

One or more pairs of transport rollers (not shown) are disposed in each of the receiving path 20, the first switchback path 21, the second switchback path 22, and the discharge path 23.

When the printing device 2 continuously performs the recording on a plurality of mediums M, the plurality of mediums M sent from the printing device 2 to the transport device 3 are alternately sent to a transport path passing through the first switchback path 21 and a transport path passing through the second switchback path 22. Therefore, throughput of medium transport in the transport device 3 can be increased.

Also, the printing system 1 can be configured to not include the transport device 3. That is, a configuration is possible in which the printing device 2 is coupled to the post-processing device 4 and the medium M obtained after the recording is performed in the printing device 2 is directly sent to the post-processing device 4 without passing through the transport device 3.

As in the present embodiment, in the configuration in which the medium M obtained after the recording is performed in the printing device 2 is sent to the post-processing device 4 through the transport device 3, a transport distance of the medium M and a transport time of the medium M become long, as compared with a configuration in which the medium M obtained after the recording is performed in the printing device 2 is directly sent to the post-processing device 4 without passing through the transport device 3, and thus the ink absorbed into the medium M to be sent to the post-processing device 4 can be dried more.

As above, the transport device 3 has a role of drying the ink absorbed into the medium M.

The medium M is delivered from the discharge path 23 of the transport device 3 to a transport path 31 of the post-processing device 4. In FIG. 1, the discharge path 23 is indicated by a broken line, and the transport path 31 is indicated by a solid line.

In the transport path 31 of the post-processing device 4, a pair of transport rollers 32, a pair of discharge rollers 33, a discharge unit 50, and a discharge port 98 are sequentially disposed along a +Y direction. In the transport path 31, a direction facing the discharge port 98 from the pair of transport rollers 32 is a transport direction.

Therefore, the pair of transport rollers 32 are disposed upstream of the transport path 31 in the transport direction, and the discharge unit 50 is disposed downstream of the transport path 31 in the transport direction. The pair of discharge rollers 33 are disposed between the pair of transport rollers 32 and the discharge unit 50.

In the post-processing device 4, the intermediate tray 35 and the processing portion 36 are disposed between the pair of discharge rollers 33 and the discharge unit 50. The intermediate tray 35 includes a placement surface 35*a* on which the medium M is placed, and a rear end alignment portion 38 disposed to be orthogonal to the placement surface 35*a*.

The medium M delivered from the transport device 3 is transported in the +Y direction by the pair of transport rollers 32, is discharged to the intermediate tray 35 by the pair of discharge rollers 33, and is placed on the intermediate tray 35. On the medium M placed on the intermediate tray 35, post processing, such as stapling processing and punching processing, is performed by the processing portion 36. That is, the post processing, such as the stapling processing and the punching processing, is performed on the medium M on the intermediate tray 35.

The medium M post-processed on the intermediate tray 35 is discharged from the discharge port 98 to an outside of the post-processing device 4 by the discharge unit 50, and is placed on the discharge tray 37.

Further, the post-processing device 4 is provided with a medium pressing member 91. The medium pressing member 91 is rotatable while using the pivot shaft 91*a* as a rotation center. The medium pressing member 91 presses the medium M placed on the discharge tray 37 such that the medium M placed on the discharge tray 37 does not float up from the discharge tray 37.

In addition, the medium pressing member 91 is disposed at a position that does not hinder the discharge of the medium M when the medium M is discharged from the discharge port 98 toward the discharge tray 37.

Further, the post-processing device 4 includes an elevating mechanism 94 and a controller 96 inside.

The elevating mechanism 94 elevates and lowers the discharge tray 37 in the Z direction (a +Z direction and a −Z direction). That is, the discharge tray 37 can be moved in the Z direction by the elevating mechanism 94.

The controller 96 includes hardware, such as a Central Processing Unit (CPU), a Read Only Memory (ROM) and a Random Access Memory (RAM), and controls various operations of the post-processing device 4. Further, the controller 96 is electrically coupled to the controller 15 of the printing device 2 to acquire information, such as the print data, from the controller 15 of the printing device 2.

Next, with reference to FIG. 2, the discharge and placement of the medium M to the intermediate tray 35 and the discharge tray 37 will be described.

Note that, in FIG. 2, an A4 size medium M is indicated by a broken line, and an A3 size medium M is indicated by a one-dot chain line. In addition, an upstream end of the medium M in the transport direction is referred to as a rear end E1, and a downstream end of the medium M in the transport direction is referred to as a front end E2.

As shown in FIG. 2, the medium M discharged from the pair of discharge rollers 33 proceeds on the placement surface 35*a* in the +Y direction until the front end E2 is landed on the placement surface 35*a* of the intermediate tray 35 and the rear end E1 is removed from a nip of the pair of discharge rollers 33.

A guide member 41 is provided in the +Y direction with respect to the pair of discharge rollers 33, the guide member 41 is positioned at a retractable position indicated by a solid line in FIG. 2 while the medium M is discharged (transported) by the pair of discharge rollers 33, and the guide member 41 does not hinder the discharge of the medium M by the pair of discharge rollers 33. Further, when the rear end E1 of the medium M is removed from the nip of the pair of discharge rollers 33, the guide member 41 advances to an advancement position indicated by a two-dot chain line. At this time, the medium M falls on the placement surface 35*a* by a weight of the medium M, and is reliably placed on the placement surface 35*a* by the guide member 41 displaced from the retractable position to the advancement position.

In addition, an upper side of the intermediate tray 35 is provided with a paddle 40 that rotates by being in contact with the medium M discharged to the intermediate tray 35 and moves the medium M toward the rear end alignment portion 38 of the intermediate tray 35. The paddle 40 is a plate-shaped body, and a plurality of plate-shaped bodies are attached along an outer periphery of a rotating shaft 40A at intervals. The guide member 41 is configured such that the +Y direction, which is downstream in the discharge direction, is attached to a swing shaft 41A to be swingable using a side of the −Y direction as a free end.

When the medium M is placed on the placement surface 35*a*, the paddle 40 rotates in a counterclockwise direction in FIG. 2. As the paddle 40 rotates while being in contact with the medium M, the medium M advances in the −Y direction. In addition, since the placement surface 35*a* of the intermediate tray 35 is inclined upward to face the +Y direction, the medium M advances in the −Y direction due to the inclination.

The intermediate tray 35 includes the rear end alignment portion 38 that aligns the rear end E1 of the medium M on the side of the −Y direction. When the rear end E1 of the medium M moves in the direction facing the rear end alignment portion 38 and the rear end E1 of the medium M is stuck against the rear end alignment portion 38, the position of rear end E1 of the medium M placed on the placement surface 35*a* of the intermediate tray 35 is arranged, and the medium M placed on the intermediate tray 35 is aligned.

In a state in which the A3 size medium M is placed on the intermediate tray 35 and the position of the rear end E1 of the A3 size medium M is arranged, the front end E2 (downstream end in the transport direction) of the A3 size medium M is disposed on an outside of the discharge port 98 (outside of the post-processing device 4). In a state in which the A3 size medium M is placed on the intermediate tray 35, a part of the A3 size medium M is disposed on the outside of the discharge port 98. The part of the A3 size medium M disposed on the outside of the discharge port 98 is deformed in the −Z direction due to gravity.

In a state in which the A4 size medium M is placed on the intermediate tray 35 and the position of the rear end E1 of the A4 size medium M is arranged, the front end E2 (downstream end in the transport direction) of the A4 size medium M is disposed on an inside of the discharge port 98 (inside of the post-processing device 4).

In the present embodiment, an auxiliary paddle 44 that rotates with respect to a rotating shaft 44A is provided on a lower side of the pair of discharge rollers 33. The auxiliary paddle 44 is disposed in the −Y direction rather than the paddle 40, and rotates in the counterclockwise direction like the paddle 40. When the auxiliary paddle 44 is provided, the medium M can be more reliably stuck against the rear end alignment portion 38 to be aligned.

In addition, the intermediate tray 35 is provided with a width direction alignment member (not shown) that aligns the ends of the medium M in the width direction. The width direction alignment member aligns the ends of the medium M in the width direction by being abutted against the ends of the medium M in the width direction.

A timing for displacing the guide member 41 to the retractable position and the advancement position and a timing for rotating the paddle 40, and a timing for performing an alignment operation in the width direction alignment member can be determined based on detection of the medium M in a medium detection unit 39 provided upstream of the pair of discharge rollers 33. For example, each operation can be performed after a predetermined time elapses after the rear end E1 of the medium M is detected in the medium detection unit 39.

The post processing, such as the stapling processing, is performed by the processing portion 36 on the plurality of mediums M placed on the intermediate tray 35 through alignment of the rear end E1 of the mediums M and the both ends in the width direction. The medium M, on which the post processing is performed by the processing portion 36, is discharged to the discharge tray 37 from the intermediate tray 35 through the discharge port 98 by the discharge unit 50 configured to include an upper-side roller 42 and a lower-side roller 43.

The discharge tray 37 is configured with a material (for example, resin) that makes the medium M easily slide. That is, the discharge tray 37 is configured with a material that reduces friction with the medium M.

The lower-side roller 43 included in the discharge unit 50 is rotationally driven by a motor (not shown), and the upper-side roller 42 comes in contact with the medium M to be driven to be rotated.

A support member (not shown) that supports the upper-side roller 42 is swingably provided around a swing shaft (not shown), and can be switched between a separated state in which the upper-side roller 42 is separated from the lower-side roller 43 by a drive source (not shown) and an approaching state in which the upper-side roller 42 is closer to the lower-side roller 43 than the separated state.

The upper-side roller 42 is in the separated state while the medium M is being discharged from the pair of discharge rollers 33 to the intermediate tray 35. When the medium M placed on the intermediate tray 35 is discharged to the discharge tray 37, the upper-side roller 42 is in the approaching state. When the upper-side roller 42 becomes the approaching state, the medium M is nipped between the upper-side roller 42 and the lower-side roller 43. The medium M nipped between the upper-side roller 42 and the lower-side roller 43 is discharged to the outside from the discharge port 98 and is placed on the discharge tray 37.

Specifically, when the rear end E1 of the medium M slips out of the nip between the upper-side roller 42 and the lower-side roller 43 to be disposed on the outside of the discharge port 98, the medium M falls by the weight of the medium M in the −Z direction and is placed on a support surface 37*a* of the discharge tray 37.

In FIG. 2, a reference numeral 37*b* indicates a wall surface positioned in the −Y direction with respect to the discharge tray 37, and the rear end E1 of the medium M placed on the discharge tray 37 abuts against a wall surface 37*b*. In addition, the support surface 37*a* of the discharge tray 37, which supports the medium M, is inclined downward to face the −Y direction (to face the wall surface 37*b*). Therefore, the medium M supported by the support surface 37*a* of the discharge tray 37 slides in the −Y direction (toward the wall surface 37*b*), and the rear end E1 of the medium M abuts against the wall surface 37*b*.

The printing device 2 ejects the ink from the line head 10 to the medium M based on the print data to record a desired image on the medium M. Moisture of the ink ejected from the line head 10 is absorbed into the medium M. The transport device 3 is disposed between the printing device 2 and the post-processing device 4 to promote evaporation of the moisture of the ink absorbed into the medium M.

Specifically, the medium M, to which the ink is ejected from the line head 10, is dried in the transport paths of the printing device 2 and the transport device 3, and the moisture absorbed into the medium M is removed.

A density of the image recorded on the medium M is not uniform, and the medium M includes, for example, a part at which the print duty is high such that a dark image is formed (a part at which the amount of ejected ink is large), and a part at which the print duty is low such that a light image is formed (a part at which the amount of ejected ink small). The part at which the print duty of the medium M is high absorbs a large amount of moisture, and the part at which the print duty of the medium M is low absorbs a small amount of moisture.

However, removal of moisture in the transport paths of the printing device 2 and the transport device 3 is limited, and the medium M containing moisture is carried into the post-processing device 4.

For example, when the medium M in which the print duty is high (the amount of ejected ink is large) is carried into the post-processing device 4, the medium M which has a large amount of moisture (the medium M containing a large amount of moisture) is carried into the post-processing device 4. When the medium M in which the print duty is low (the amount of ejected ink is small) is carried into the post-processing device 4, a medium M which has a small amount of moisture (the medium M containing a small amount of moisture) is carried into the post-processing device 4.

A rigidity of the medium M changes according to the amount of moisture contained in the medium M (the amount of moisture in the medium M). Since the amount of moisture in the medium M is proportional to the amount of ink ejected from the line head 10 to the medium M, the rigidity of the medium M changes according to the amount of ink ejected from the line head 10 to the medium M.

The post-processing device 4 performs the post processing on the medium M whose rigidity changes according to the amount of ink ejected from the line head 10 to the medium M.

For example, when the amount of moisture in the medium M increases, the rigidity of the medium M becomes small, and thus the medium M is easily deformed. When the amount of moisture in the medium M decreases, the rigidity of the medium M increases, and thus the medium M is hardly deformed. Therefore, when the gravity acts on the medium M, the medium M which has a large amount of moisture is easily deformed in the −Z direction (gravity direction), and the medium M which has a small amount of moisture is hardly deformed in the −Z direction. As above, the medium M which has a large amount of moisture is significantly deformed in the −Z direction due to the gravity as compared with the medium M which has a small amount of moisture.

In addition, since the amount of moisture contained in the medium M (the amount of moisture in the medium M) is proportional to the amount of ejected ink, the rigidity of the medium M can be predicted based on the print data.

That is, the line head 10 ejects the ink to the medium M based on the print data, and the amount of ink is acquired based on the print data, and thus the amount of moisture in the medium M can be predicted based on the print data and the rigidity of the medium M can be predicted.

Figure 3:
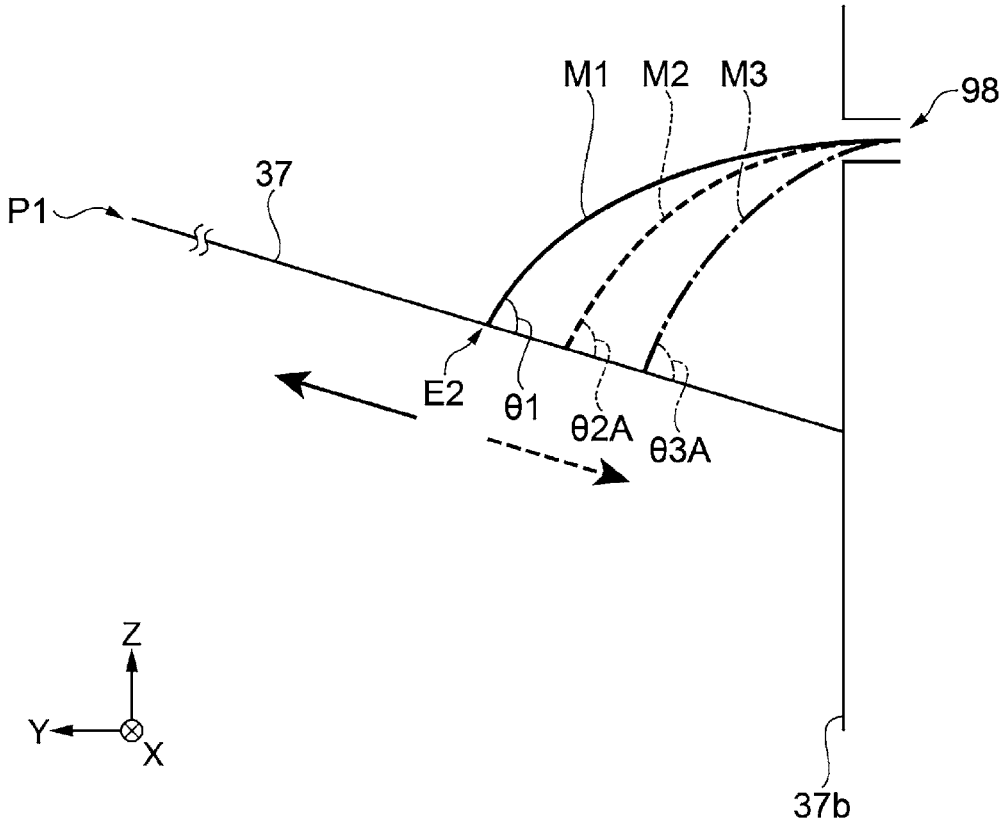
FIG. 3 is a schematic diagram showing a state of a medium discharged from a discharge port according to the first embodiment.
Figure 4:
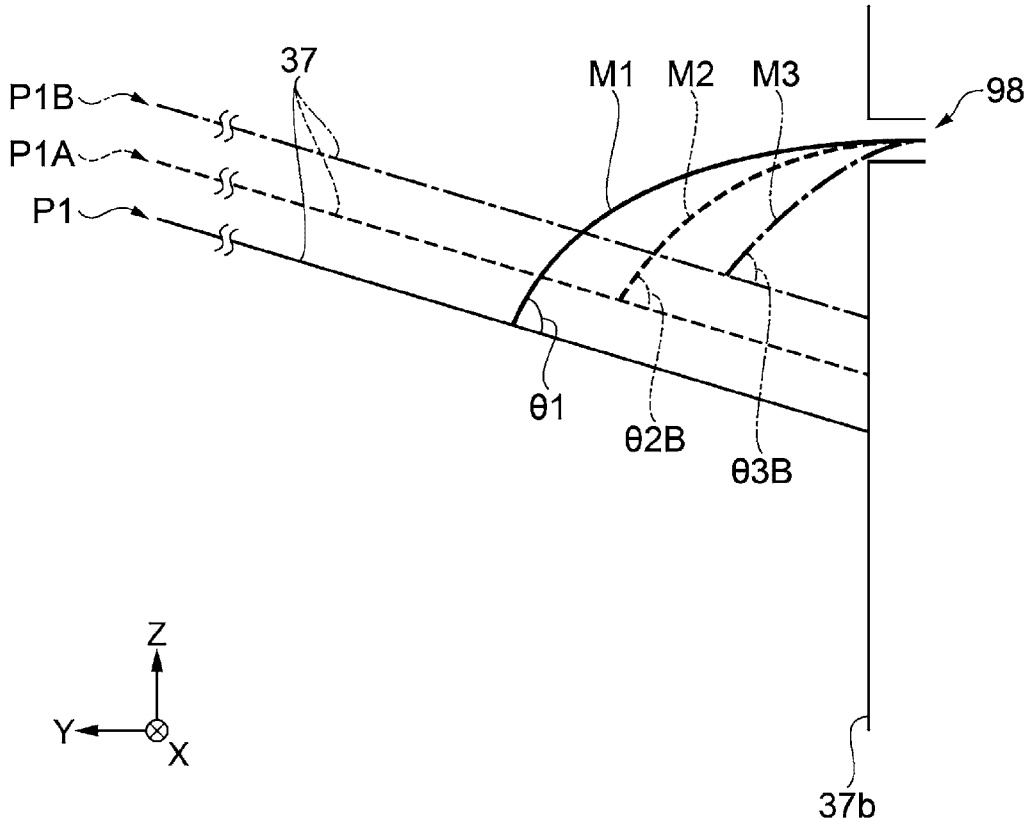
FIG. 4 is another schematic diagram showing the state of the medium discharged from the discharge port according to the first embodiment.

FIG. 3 is a schematic diagram showing a state of the medium M discharged from the discharge port 98. FIG. 4 is another schematic diagram showing the state of the medium M discharged from the discharge port 98.

In FIGS. 3 and 4, the medium M, which has a small amount of moisture, is indicated by a solid line, the medium M, which has a large amount of moisture, is indicated by a broken line, and a bundle of mediums M obtained by performing the stapling processing on the medium M which has a large amount of moisture is indicated by a one-dot chain line.

The medium M, which has a small amount of moisture and is indicated by the solid line, has the high rigidity and is hardly deformed in the −Z direction. Hereinafter, the medium M is referred to as a medium M1 which is hardly deformed. The medium M, which has a large amount of moisture and is indicated by the broken line, has the small rigidity and is easily deformed in the −Z direction. Hereinafter, the medium M is referred to as a medium M2 which is easily deformed. The bundle of mediums M, which has a large amount of moisture and is indicated by the one-dot chain line, is heavier than the medium M which has a large amount of moisture, thereby being easily deformed in the −Z direction. Hereinafter, the bundle of mediums M is referred to as a bundle M3 of mediums which are easier to be deformed.

The medium M1 which is hardly deformed includes the medium M which does not contain moisture in addition to the medium M which has a small amount of moisture. In addition, the number of mediums M1 which are hardly deformed is not limited to the singular and may be plural. For example, when deformation of the bundle of mediums M1 which are hardly deformed (the plurality of mediums M1 which are hardly deformed) in the gravity direction is at the same degree as deformation of the single medium M1 which is hardly deformed in the gravity direction, the bundle of the plurality of the mediums M1 which are hardly deformed is included in the medium M1 which is hardly deformed.

The bundle M3 of mediums which are easier to be deformed includes a bundle of a plurality of mediums M2 which are easily deformed. When the bundle of the plurality of mediums M2 which are easily deformed is deformed in the gravity direction due to the gravity more than the single medium M2 which is easily deformed, the bundle of the plurality of mediums M2 which are easily deformed is included in the bundle M3 of mediums which are easier to be deformed.

Note that, when the deformation of the bundle of the plurality of mediums M2 which are easily deformed in the gravity direction is at the same degree as the deformation of the single medium M2 which is easily deformed in the gravity direction, the bundle of the plurality of mediums M2 which are easily deformed is included in the medium M2 which is easily deformed. Therefore, the number of mediums M2 which are easily deformed is not limited to the singular and may be the plural.

Further, as shown in FIG. 3, when the gravity acts on the medium M1 which is hardly deformed, the medium M2 which is easily deformed, and the bundle of mediums M3 which are easier to be deformed, the deformation in the gravity direction becomes large in the order of the medium M1 which is hardly deformed, the medium M2 which is easily deformed, and the bundle of mediums M3 which are easier to be deformed.

As indicated by the solid line in FIG. 3, the medium M1, which is hardly deformed and is discharged to the outside of the discharge port 98, is influenced by the gravity to be deformed in the −Z direction. At a point in time at which the front end E2 of the medium M1 which is hardly deformed comes in contact with the discharge tray 37, an angle formed by the medium M1 which is hardly deformed and the discharge tray 37 is θ1, and, hereinafter, is referred to as an angle θ1 obtained when coming in contact with the medium M1 which is hardly deformed.

As indicated by the broken line in FIG. 3, the medium M2, which is easily deformed to be discharged to the outside of the discharge port 98, is largely deformed in the −Z direction due to the gravity as compared with the medium M1 which is hardly deformed. At a point in time at which the front end E2 of the medium M2 which is easily deformed comes in contact with the discharge tray 37, an angle formed by the medium M2 which is easily deformed and the discharge tray 37 is θ2A, and, hereinafter, is referred to as an angle θ2A obtained when coming in contact with the medium M2 which is easily deformed.

As indicated by the one-dot chain line in FIG. 3, the bundle M3 of the mediums, which are easier to be deformed to be discharged to the outside of the discharge port 98, is largely deformed in the −Z direction due to the gravity as compared with the medium M2 which is easily deformed. At a point in time at which the front end E2 of the bundle M3 of mediums which are easier to be deformed comes in contact with the discharge tray 37, an angle formed by the bundle M3 of mediums which are easier to be deformed and the discharge tray 37 is θ3A, and, hereinafter, is referred to as an angle θ3A obtained when coming in contact with the bundle M3 of mediums which are easier to be deformed.

In addition, at a point in time at which the front end E2 of the medium M comes in contact with the discharge tray 37, an angle θ formed by the medium M and the discharge tray 37 is referred to as the angle θ obtained when coming in contact with the medium M.

A degree of deformation in the −Z direction due to the gravity increases in the order of the medium M1 which is hardly deformed, the medium M2 which is easy to be deformed, and the bundle M3 of mediums which are easier to be deformed. Therefore, the angle θ obtained when coming in contact with the medium M becomes large in an order of the contact angle θ1 of the medium M1 which is hardly deformed, the angle θ2A obtained when coming in contact with the medium M2 which is easily deformed, and the contact angle θ3A obtained when coming in contact with the bundle M3 of mediums which are easier to be deformed. That is, the inclination of the medium M with respect to the discharge tray 37 becomes steep in the order of the medium M1 which is hardly deformed, the medium M2 which is easy to be deformed, and the bundle M3 of mediums which are easier to be deformed.

In the post-processing device 4 according to the present embodiment, when the medium M1 which is hardly deformed is discharged to the discharge tray 37, the discharge tray 37 is disposed at a position P1 at which buckling does not occur in the medium M1 which is hardly deformed on the discharge tray 37. When the discharge tray 37 is disposed at the position P1, the angle obtained when coming in contact with the medium M1 which is hardly deformed becomes θ1. In other words, the discharge tray 37 is disposed at the position P1 such that the angle obtained when coming in contact with the medium M1 which is hardly deformed becomes θ1.

Note that, the position P1 is an example of a first normal position in the present application, and, hereinafter, is referred to as a first normal position P1.

Further, when another medium M is placed on the discharge tray 37, the first normal position P1 is disposed at a lower side as much as a thickness of the other medium M placed on the discharge tray 37.

Note that, the buckling refers to a phenomenon that, when the front end E2 of the medium M comes in contact with the discharge tray 37, a deformation state of the medium M changes and the medium M deforms in an unintended direction.

For example, the medium M1 which is hardly deformed and which is indicated by the solid line in the drawing is discharged from the discharge port 98, and the front end E2 of the medium M1 which is hardly deformed comes in contact with the discharge tray 37. When, after the front end E2 of the medium M1 which is hardly deformed comes in contact with the discharge tray 37, the front end E2 of the medium M1 which is hardly deformed advances in a direction of a solid line arrow, the medium M1 which is hardly deformed is properly placed on the discharge tray 37 without being bent on the discharge tray 37.

The case is a case where the buckling does not occur in the medium M1 which is hardly deformed. When the buckling does not occur in the medium M1 which is hardly deformed, the medium M1 which is hardly deformed is properly placed on the discharge tray 37 without being bent on the discharge tray 37.

For example, when, after the front end E2 of the medium M1 which is hardly deformed and is indicated by the solid line in the drawing comes in contact with the discharge tray 37, the front end E2 of the medium M1 which is hardly deformed advances in a direction of a broken line arrow, the medium M1 which is hardly deformed is deformed in the unintended direction (a direction of the broken line arrow)

on the discharge tray 37, is bent on the discharge tray 37, and is not properly placed on the discharge tray 37.

The case is a case where the buckling occurs in the medium M1 which is hardly deformed. When the buckling occurs in the medium M1 which is hardly deformed, for example, the medium M1 which is hardly deformed is deformed in the unintended direction on the discharge tray 37, the medium M1 which is hardly deformed is bent on the discharge tray 37, and the medium M1 which is hardly deformed is not properly placed on the discharge tray 37.

When the medium M discharged from the discharge port 98 comes in contact with the discharge tray 37, the medium M moves in the direction of the solid line arrow.

However, when the front end E2 of the medium M comes in contact with the discharge tray 37, a force for causing the medium M to advance in the direction of the solid line arrow and a force for causing the medium M to advance in the direction of the broken line arrow (a force for inhibiting the medium M from advancing in the direction of the solid line arrow) acts with respect to the medium M. Hereinafter, the force for causing the medium M to advance in the direction of the solid line arrow is referred to as a forward force, and the force for causing the medium M to advance in the direction of the broken line arrow is referred to as a backward force.

When the angle θ obtained when coming in contact with the medium M becomes small (the medium M is gently inclined with respect to the discharge tray 37), the forward force becomes strong and the backward force becomes relatively weak, and thus the medium M easily advances in the direction of the solid line arrow and the buckling hardly occurs in the medium M.

When the angle θ obtained when coming in contact with the medium M becomes large (the medium M is sharply inclined with respect to the discharge tray 37), the forward force becomes weak and the backward force becomes relatively strong, and thus the medium M easily advances in the direction of the broken line arrow and the buckling easily occurs in the medium M.

The post-processing device 4 is in a relationship in which the buckling does not occur in the medium M when the medium M is dried while the ink is not ejected and the angle obtained when coming in contact with the medium M is equal to or smaller than θ1, and the buckling easily occurs in the medium M when the angle obtained when coming in contact with the medium M is larger than θ1. Similarly to the medium M which is dried while the ink is not ejected, the medium M1 which is hardly deformed is in a relationship in which the buckling does not occur in the medium M1 which is hardly deformed when the angle obtained when coming in contact with the medium M1 which is hardly deformed is equal to or smaller than θ1, and the buckling easily occurs in the medium M1 which is hardly deformed when the angle obtained when coming in contact with the medium M1 which is hardly deformed is larger than θ1. The relationship is the same as in another medium M (the medium M2 which is easily deformed and the bundle M3 of mediums which are easier to be deformed).

Further, the position of the discharge tray 37, at which the angle obtained when coming in contact with the medium M1 which is hardly deformed is θ1, is the first normal position P1.

Note that, the above-described relationship, the angle θ1 obtained when coming in contact with the medium M1 which is hardly deformed and on which the buckling does not occur, and the first normal position P1 are obtained by both evaluation using an actual object and evaluation using simulation. In addition, in the description below, there is a case where the angle θ1 obtained when coming in contact with the medium M in which the buckling does not occur is referred to as a standard angle θ1.

When the discharge tray 37 is disposed at the first normal position P1, the angle obtained when coming in contact with the medium M1 which is hardly deformed becomes the standard angle θ1, and thus the buckling does not occur in the medium M1 which is hardly deformed. However, since the angle θ2A obtained when coming in contact with the medium M2 which is easily deformed and the angle θ3A obtained when coming in contact with the bundle M3 of mediums which are easier to be deformed are larger than the standard angle θ1, and thus there is a problem in that the buckling occurs in the medium M2 which is easily deformed and the bundle M3 of mediums which are easier to be deformed.

Therefore, in the post-processing device 4, position of the discharge tray 37 is changed such that both the angle obtained when coming in contact with the medium M2 which is easily deformed and the angle obtained when coming in contact with the bundle M3 of mediums which are easier to be deformed are equal to or smaller than the standard angle θ1.

Specifically, as shown in FIG. 4, when the medium M2, which is easily deformed and is indicated by the broken line in the drawing, is discharged, the elevating mechanism 94 moves the discharge tray 37 in the +Z direction (the direction opposite to the gravity direction) such that the discharge tray 37 is moved from the first normal position P1 indicated by the solid line in the drawing to a first standby position P1A indicated by the broken line in the drawing. That is, when the medium M2 which is easily deformed is placed on the discharge tray 37, the elevating mechanism 94 moves the position of the discharge tray 37 to the first standby position P1A positioned in the +Z direction with respect to the first normal position P1 before the medium M2 which is easily deformed comes in contact with the discharge tray 37 or the medium M previously placed on the discharge tray 37.

When the discharge tray 37 is moved to the first standby position P1A, the angle obtained when coming in contact with the medium M2 which is easily deformed is changed to an angle θ2B smaller than the standard angle θ1. That is, the discharge tray 37 is moved from the first normal position P1 to the first standby position P1A such that the angle obtained when coming in contact with the medium M2 which is easily deformed is equal to or smaller than the standard angle θ1.

Since the angle θ2B, obtained when coming in contact with the medium M2 which is easily deformed and which is indicated by a broken line in the drawing, is smaller than the standard angle θ1, the buckling does not occur in the medium M2 which is easily deformed, and the medium M2 which is easily deformed is properly placed on the discharge tray 37.

Note that, the angle θ2B, obtained when coming in contact with the medium M2 which is easily deformed and in which the buckling does not occur, and the first standby position P1A are obtained by both the evaluation using the actual object and the evaluation using the simulation. For example, the angle θ2B, obtained when coming in contact with the medium M2 which is easily deformed, and the first standby position P1A change according to the amount of ink ejected from the line head 10 with respect to the medium M2 which is easily deformed.

Since the angle θ3A (see FIG. 3) obtained when coming in contact with the bundle M3 of mediums which are easier to be deformed is larger than the angle θ2A (see FIG. 3)

obtained when coming in contact with the medium M2 which is easily deformed, the elevating mechanism 94 further moves the discharge tray 37 in the +Z direction from the first standby position P1A indicated by the broken line in the drawing, such that the angle obtained when coming in contact with the bundle M3 of mediums which are easier to be deformed is set to an angle θ3B which is smaller than the standard angle θ1. Specifically, in order to set the angle obtained when coming in contact with the bundle M3 of mediums which are easier to be deformed to the angle θ3B which is smaller than the standard angle θ1, the elevating mechanism 94 moves the discharge tray 37 to the first standby position P1B positioned in the +Z direction with respect to the first standby position P1A.

Since the angle θ3B, obtained when coming in contact with the bundle M3 of the mediums which are easier to be deformed and which is indicated by the one-dot chain line in the drawing, is smaller than the standard angle θ1, the buckling does not occur in the bundle M3 of mediums which are easier to be deformed, and thus the bundle M3 of mediums which are easier to be deformed is properly placed on the discharge tray 37.

Note that, the angle θ3B, obtained when coming in contact with the bundle M3 of the mediums which are easier to be deformed and in which the buckling does not occur, and the first standby position P1B are obtained by both the evaluation using the actual object and the evaluation using simulation. For example, the angle θ3B, obtained when coming in contact with the bundle M3 of mediums which are easier to be deformed, and the first standby position P1B change according to the amount of ink ejected from the line head 10 with respect to the bundle M3 of mediums which are easier to be deformed.

As above, the elevating mechanism 94 can move the discharge tray 37 to the first normal position P1 and a first standby position P1A or P1B positioned in the +Z direction (direction opposite to the gravity direction) with respect to the first normal position P1. Further, the elevating mechanism 94 moves the discharge tray 37 to the first normal position P1 or the first standby position P1A or P1B according to the amount of ink before the medium M (the medium M1 which is hardly deformed, the medium M2 which is easily deformed, and the bundle M3 of mediums which are easier to be deformed) comes in contact with the discharge tray 37 or the medium M which is previously placed on the discharge tray 37.

Figure 5:
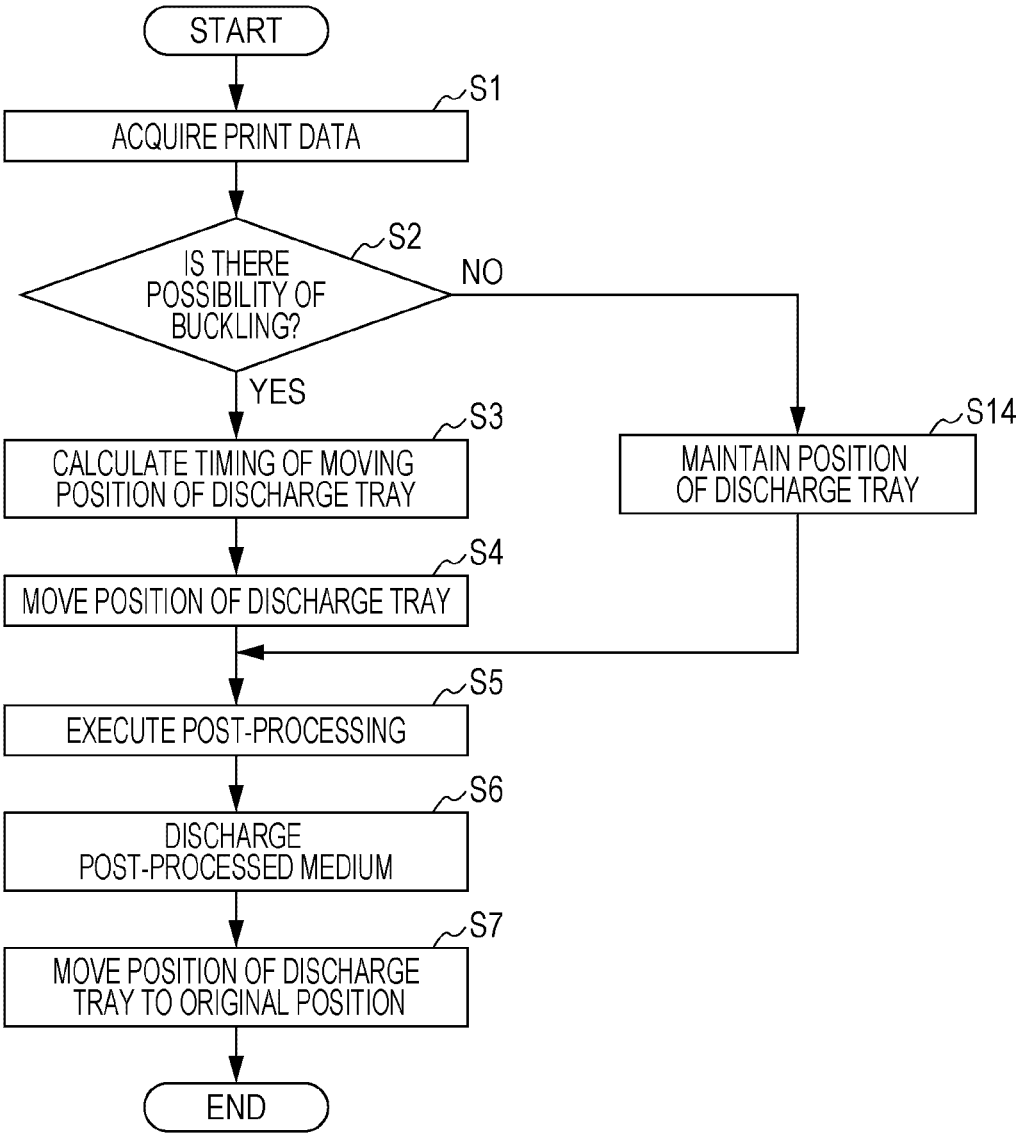
FIG. 5 is a flowchart showing a processing method of the post-processing device according to the first embodiment.

FIG. 5 is a flowchart showing a processing method of the post-processing device 4 according to the present embodiment. FIG. 5 summarizes steps for performing the post processing with respect to the medium M whose rigidity changes according to the amount of ink ejected from the line head 10 to the medium M.

Next, with reference to FIG. 5, the processing method of the post-processing device 4 according to the present embodiment will be described.

As shown in FIG. 5, in step S1, when the medium M, on which a desired image is recorded in the printing device 2, is sent to the post-processing device 4 through the transport device 3, the controller 96 of the post-processing device 4 acquires the print data, such as the print duty and the size of the medium M (a length of the medium M in the transport direction), from the controller 15 of the printing device 2. Furthermore, the controller 96 of the post-processing device 4 acquires, from the controller 15 of the printing device 2, the temperature of the environment, the humidity of the environment, the transport speed of the medium M transported in the transport direction, the stop time of the medium M transported in the transport direction, and the number of mediums M post-processed on the intermediate tray 35.

The transport speed of the medium M is an average value of speed at which the medium M is transported in the transport path until the medium M, to which the ink is ejected from the line head 10, is fed into the post-processing device 4. The stop time of the medium M is a total time during which the transport of the medium M is stopped in the transport path until the medium M, to which the ink is ejected from the line head 10, is fed into the post-processing device 4.

Note that, the temperature of the environment, the humidity of the environment, the transport speed of the medium M, and the stop time of the medium M are examples of a parameter which influences the drying of the liquid in the present application, and, hereinafter, are referred to as the parameter which influences the drying of the liquid. The size of the medium M (the length of the medium M in the transport direction) and the number of mediums M to be post-processed on the intermediate tray 35 are examples of a parameter which influences the deformation of the medium M due to the gravity in the present application, and, hereinafter, are referred to as the parameter which influences the deformation due to the gravity.

In addition, in step S1, the discharge tray 37 is disposed at the first normal position P1.

When the rear end E1 of the medium M slips out of the nip between the upper-side roller 42 and the lower-side roller 43 and is disposed on the outside of the discharge port 98, the medium M falls by the weight of the medium M in the −Z direction and is placed on the discharge tray 37.

When the discharge tray 37 is disposed at the first normal position P1, a space in which the medium M falls stably toward the discharge tray 37 is secured, and the medium M is properly placed on the discharge tray 37. However, when the discharge tray 37 is disposed at the first standby position P1A or P1B, the space in which the medium M falls stably toward the discharge tray 37 is not secured, and thus there is a problem in that the medium M is not properly placed on the discharge tray 37.

In step S2, the controller 96 predicts a change in the rigidity of the medium M, including the print data and the parameter which influences the drying of the liquid.

The controller 96 acquires the amount of ink ejected from the line head 10 to the medium M based on the print data, and predicts that the change in the rigidity of the medium M is large when the amount of ink ejected to the medium M is large, and predicts that the change in the rigidity of the medium M is small when the amount of ink ejected to the medium M is small.

When the ink is dried quickly due to the parameter which influences the drying of the liquid, the controller 96 predicts that the amount of moisture contained in the medium M becomes small and the change in the rigidity of the medium M becomes small, and predicts that the amount of moisture contained in the medium M increases and the change in the rigidity of the medium M increase when the ink is not dried quickly.

As above, in step S2, the controller 96 predicts the change in the rigidity of the medium M, including the print data and the parameter which influences the drying of the liquid. In addition, the parameter which influences the drying of the liquid includes at least one of the temperature of the environment, the humidity of the environment, the transport speed of the medium transported in the transport direction, and the stop time of the medium transported in the transport direction. With the configuration, an accuracy of the prediction can be improved as compared with a case where the controller 96 predicts the change in the rigidity of the medium M using only print data.

Further, the controller 96 examines a possibility that the buckling occurs in the medium M when the discharge tray 37 is disposed at the first normal position P1 based on the change in the rigidity of the medium M.

For example, when it is predicted that the change in the rigidity of the medium M is large, the controller 96 determines that the buckling easily occurs in the medium M in the discharge tray 37 disposed at the first normal position P1 (determined to be Yes). For example, when it is predicted that the change in the rigidity of the medium M is small, the controller 96 determines that the buckling hardly occurs in the medium M in the discharge tray 37 disposed at the first normal position P1 (determined to be No).

In step S2, when the controller 96 determines that the buckling hardly occurs in the medium M in the discharge tray 37 (determined to be No), step S14 is executed. In step S14, the position of the discharge tray 37 is not moved, and the position of the discharge tray 37 is maintained at the first normal position P1.

When the controller 96 determines that the buckling easily occurs in the medium M in the discharge tray 37 (determined to be Yes) in step S2, the controller 96 examines a timing of moving the discharge tray 37 (a timing of executing step S4) in step S3.

The timing of moving the discharge tray 37 is determined based on the detection of the medium M in the medium detection unit 39 provided upstream of the pair of discharge rollers 33.

When the controller 96 determines that the buckling easily occurs in the medium M in the discharge tray 37 (determined to be Yes) in step S2, step S4 is executed.

In step S4, the elevating mechanism 94 moves the discharge tray 37 in the +Z direction (direction opposite to the gravity direction), before the medium M comes in contact with the discharge tray 37 or the medium M previously placed on the discharge tray 37, to dispose the discharge tray 37 at the first standby position P1A or P1B.

Further, in step S4, the controller 96 evaluates the degree of the influence of gravity using the parameter which influences the deformation due to the gravity. When the controller 96 determines that the medium M is largely deformed in the gravity direction due to the parameter which influences the deformation due to the gravity, the elevating mechanism 94 moves the discharge tray 37 in the +Z direction (direction opposite to the gravity direction) with respect to the first standby position P1A or P1B before the medium M comes in contact with the discharge tray 37 or the medium M previously placed on the discharge tray 37 such that the buckling does not occur in the medium M even when the influence of gravity is large. That is, the elevating mechanism 94 changes the first standby position of the discharge tray 37 according to the parameter which influences the deformation due to the gravity.

In addition, the parameter which influences the deformation due to the gravity includes at least one of the length of the medium M in the transport direction and the number of mediums M to be post-processed on the intermediate tray 35.

When the A3 size medium M is transported toward the intermediate tray 35, a state is made in which the front end E2 of the A3 size medium M is disposed on the outside of the discharge port 98. Then, at a stage before the A3 size medium M is placed on the intermediate tray 35, the front end E2 of the A3 size medium M comes in contact with the discharge tray 37, and thus there is a problem in that the front end E2 of the A3 size medium M is deformed in an unintended direction on the discharge tray 37.

In this case, at the stage before the A3 size medium M is placed on the intermediate tray 35, the elevating mechanism 94 moves the discharge tray 37 in the +Z direction and disposes the discharge tray 37 at the first standby position P1A or P1B, such that the front end E2 of the A3 size medium M is not deformed in the unintended direction on the discharge tray 37.

As above, when the front end E2 of the A3 size medium M is disposed on the outside of the discharge port 98 in a state in which the A3 size medium M is placed on the intermediate tray 35, the elevating mechanism 94 moves the position of the discharge tray 37 in the +Z direction at the state before the A3 size medium M is placed on the intermediate tray 35.

In addition, when the A4 size medium M is placed on the intermediate tray 35, the front end E2 of the A4 size medium M is disposed on an inside of the discharge port 98 (on an inside of the post-processing device 4).

In this case, until the medium M comes in contact with the discharge tray 37 or the medium M previously placed on the discharge tray 37 after the medium M of A4 size is placed on the intermediate tray 35, the elevating mechanism 94 moves the position of the discharge tray 37 in the +Z direction and disposes the discharge tray 37 at the first standby position P1A or P1B.

As above, with regard to the A3 size medium M and the A4 size medium M, the timing of moving the position of the discharge tray 37 in the +Z direction is different.

As above, in steps S2, S4, and S14, a possibility that the buckling occurs in the medium M is examined, and the discharge tray 37 is moved in advance to a position where the buckling does not occur in the medium M before the medium M comes in contact with the discharge tray 37.

In step S5, the controller 96 controls the processing portion 36 such that the processing portion 36 performs the post processing, such as the stapling processing and the punching processing, on the medium M.

In step S6, when the medium M1 which is hardly deformed is discharged to the discharge tray 37, the discharge tray 37 is disposed at the first normal position P1, and thus the buckling does not occur in the medium M1 which is hardly deformed and the medium M1 which is hardly deformed is properly placed on the discharge tray 37. When the medium M2 which is easily deformed is discharged to the discharge tray 37, the discharge tray 37 is disposed at the first standby position P1A, and thus the buckling does not occur in the medium M2 which is easily deformed and the medium M2 which is easily deformed is properly placed on the discharge tray 37. When the bundle M3 of the mediums, which are easier to be deformed, is discharged to the discharge tray 37, the discharge tray 37 is disposed at the first standby position P1B, and thus the buckling does not occur in the bundle M3 of mediums which are easier to be deformed and the bundle M3 of the mediums, which are easier to be deformed, is properly placed on the discharge tray 37.

In step S7, when the discharge tray 37 moves from the first normal position P1 to the first standby position P1A or P1B in step S4, the controller 96 moves the discharge tray 37 from the first standby position P1A or P1B to the first normal position P1 until the rear end E1 of the medium M is discharged from the discharge port 98 by the elevating mechanism 94 in step S7. That is, the elevating mechanism 94 lowers the discharge tray 37 that is raised in the +Z direction to an original position (first normal position P1) until the rear end E1 of the medium is discharged from the discharge port 98.

When the discharge tray 37 is disposed at the original position (first normal position P1), the medium pressing member 91 becomes rotatable, and thus the medium pressing member 91 can press the medium M such that the medium M placed on the discharge tray 37 does not float up from the discharge tray 37.

Further, when the discharge tray 37 is disposed at the original position (first normal position P1), a space in which a next medium M falls stably toward the discharge tray 37 is secured, and the next medium M is properly placed on the discharge tray 37.

Note that, when the discharge tray 37 is maintained at the first normal position P1 in step S14, step S7 is not executed.

In the post-processing device 4 according to the present embodiment, when the front end E2 of the medium M comes in contact with the discharge tray 37, the position of the discharge tray 37 is lowered to the original position (first normal position P1) while the medium M is being discharged to the discharge tray 37. Therefore, when the medium M2 which is easily deformed is discharged, the discharge tray 37 moves up and down between the first normal position P1 and the first standby position P1A. In addition, when the position of the discharge tray 37 is lowered to the original position (first normal position P1) and the next medium M2 which is easily deformed is discharged to the discharge tray 37, a space for receiving the next medium M2 which is easily deformed is secured and the next medium M2 which is easily deformed is properly placed on the discharge tray 37.

As described above, the elevating mechanism 94 can move the discharge tray 37 to the first normal position P1 and the first standby position P1A or P1B positioned in the +Z direction with respect to the first normal position P1. Further, the elevating mechanism 94 moves the discharge tray 37 to the first normal position P1 or the first standby position P1A or P1B according to the amount of ink before the medium M comes in contact with the discharge tray 37 or the medium M previously placed on the discharge tray 37.

With the configuration, when the medium M comes in contact with the discharge tray 37, the buckling hardly occurs in the medium M, and thus the medium M is properly placed on the discharge tray 37.

Note that, the above-described configuration acts more effectively when the post processing is performed on printed matter using water-based ink. Further, instead of moving the discharge tray 37 to the first normal position P1 or the first standby position P1A or P1B according to the amount of ink, the discharge tray 37 may be moved to the first normal position P1 or the first standby position P1A or P1B according to the ratio of an area of the region to which the ink is ejected to an area of one piece of medium M.

2. Second Embodiment

Figure 6:
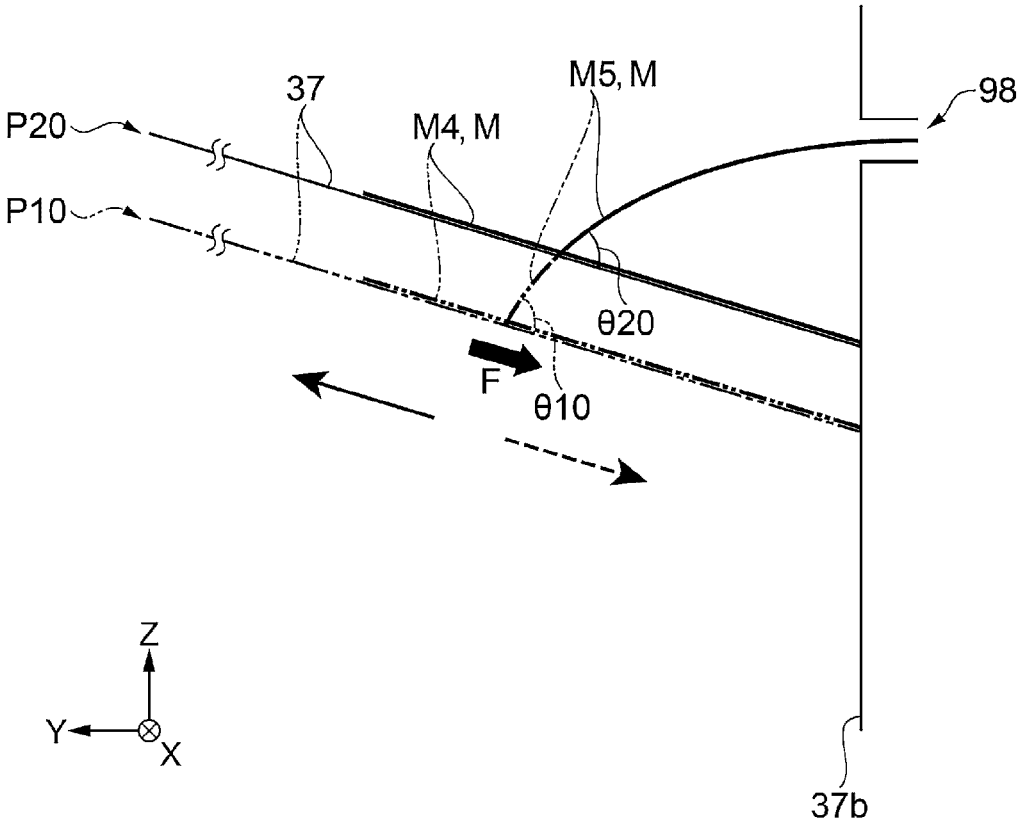
FIG. 6 is a schematic diagram showing a state of a medium discharged from a discharge port according to a second embodiment.

FIG. 6 is a schematic diagram showing a state of the medium M discharged from the discharge port 98 according to a second embodiment.

In the second embodiment and the first embodiment, the post-processing device 4 has the same configuration. That is, in the present embodiment and the first embodiment, the post-processing device 4 includes the intermediate tray 35 on which the medium M transported in the transport direction is placed, the discharge port 98 through which the medium M post-processed on the intermediate tray 35 is discharged, the discharge tray 37 which is disposed in the −Z direction with respect to the discharge port 98 and on which the medium M discharged from the discharge port 98 is placed, and the elevating mechanism 94 which elevates the discharge tray 37.

In the present embodiment, the medium M discharged from the discharge port 98 comes in contact with the previous medium M placed on the discharge tray 37 and is placed on the previous medium M placed on the discharge tray 37. In the first embodiment, the medium M discharged from the discharge port 98 comes in contact with the discharge tray 37 and is placed on the discharge tray 37. This is a difference between the present embodiment and the first embodiment.

Note that, the previous medium M placed on the discharge tray 37 illustrated in FIG. 6 is an example of a first medium in the present application, and is hereinafter referred to as a first medium M4. The medium M discharged from the discharge port 98 shown in FIG. 6 is an example of a second medium in the present application, and is hereinafter referred to as a second medium M5.

Hereinafter, with reference to FIG. 6, an outline of the second embodiment will be described focusing on the difference from the first embodiment. In addition, the same components as in the first embodiment are indicated by the same reference numerals, and description thereof will not be repeated.

As shown in FIG. 6, the first medium M4 is placed on the discharge tray 37, and the second medium M5 discharged from the discharge port 98 comes in contact with the first medium M4 placed on the discharge tray 37 and is placed on the first medium M4 placed on the discharge tray 37.

When the second medium M5 discharged from the discharge port 98 comes in contact with the first medium M4 placed on the discharge tray 37, friction occurs between the first medium M4 and the second medium M5, and a frictional force F indicated by a thick solid line arrow in the drawing acts on the second medium M5.

Specifically, when the second medium M5 discharged from the discharge port 98 comes in contact with the first medium M4 placed on the discharge tray 37, the second medium M5 tends to move in a direction of the solid line arrow in the drawing. Then, due to the friction between the first medium M4 and the second medium M5, the frictional force F that prevents the second medium M5 from proceeding in the direction of the solid line arrow acts on the second medium M5. Therefore, the frictional force F indicated by the thick arrow in the drawing acts on the second medium M5 in the direction (unintended direction) indicated by the broken line arrow in the drawing. That is, the frictional force F acts on the second medium M5 in the direction in which the buckling easily occurs.

The frictional force F acting on the second medium M5 changes according to the amount of moisture in the first medium M4.

For example, when the amount of ink ejected to the first medium M4 is small and the amount of moisture contained in the first medium M4 is small, the second medium M5 easily slides on the first medium M4 and the frictional force F becomes weak. For example, when the amount of ink ejected on the first medium M4 is large and the amount of moisture contained in the first medium M4 is large, the second medium M5 is does not become slippery on the first medium M4 and the frictional force F becomes strong.

As above, the frictional force F acting on the second medium M5 changes according to the amount of ink ejected on the first medium M4. In addition, the frictional force F acting on the second medium M5 can be predicted by the amount of ink ejected on the first medium M4 (print data).

As indicated by a two-dot chain line in FIG. 6, when the frictional force F acting on the second medium M5 is weak, that is, when the second medium M5 easily slides on the first medium M4, the discharge tray 37 is positioned at a position P10. When the discharge tray 37 is disposed at the position P10, an angle obtained when coming in contact with the second medium M5 is θ10. In other words, the discharge tray 37 is disposed at the position P10 such that the angle obtained when coming in contact with the second medium M5 is θ10.

Note that, the position P10 is an example of the second normal position in the present application, and is hereinafter referred to as a second normal position P10.

In the present embodiment, when the discharge tray 37 is disposed at the second normal position P10 and the frictional force F acting on the second medium M5 from the first medium M4 is weak, the buckling does not occur in the second medium M5. In other words, when the frictional force F acting on the second medium M5 from the first medium M4 is weak, the position of the discharge tray 37 is set to the second normal position P10 such that the buckling does not occur in the second medium M5 discharged from the discharge port 98.

In addition, the angle θ10 when coming in contact with the second medium M5 and the second normal position P10 are obtained by both the evaluation using the actual object and the evaluation using simulation.

However, when the frictional force F acting on the second medium M5 becomes strong, that is, when the second medium M5 hardly slides on the first medium M4, the discharge tray 37 is disposed at the second normal position P10. When the front end E2 of the second medium M5 comes in contact with the first medium M4 even though the angle when coming in contact with the second medium M5 is θ10, the second medium M5 is easily deformed by the frictional force F in the direction of the broken line arrow, and thus the buckling easily occurs in the second medium M5.

That is, even when the discharge tray 37 is disposed at the second normal position P10 and the angle obtained when coming in contact with the second medium M5 is θ10, the frictional force F inhibits the deformation of the second medium M5 in the direction of the solid line arrow, and thus the second medium M5 is easily deformed in the direction of the broken line arrow and the buckling easily occurs in the second medium M5.

Therefore, in order to prevent the buckling of the second medium M5, the angle when coming in contact with the second medium M5 is set to be smaller than θ10 when the frictional force F acting on the second medium M5 becomes strong, and the second medium M5 is set to be easily deformed in the direction of the solid line arrow even when a strong frictional force F acts on the second medium M5, so that the buckling hardly occurs in the second medium M5.

Specifically, as indicated by the solid line in FIG. 6, the position of the discharge tray 37 is moved to a position P20 positioned in the +Z direction with respect to the second normal position P10, and the angle when coming in contact with the second medium M5 is set to θ20 which is smaller than θ10. With the configuration, even when the frictional force F acting on the second medium M5 becomes strong, the buckling hardly occurs in the second medium M5.

Note that, the position P20 of the discharge tray 37 is an example of a second standby position in the present application, and is hereinafter referred to as a second standby position P20. In addition, the angle θ20 when coming in contact with the second medium M5 and the second standby position P20 are obtained by both the evaluation using the actual object and the evaluation using simulation.

Next, with reference to FIG. 5, the processing method of the post-processing device 4 according to the present embodiment will be described focusing on a difference from the first embodiment. In addition, the description overlapping the first embodiment will not be repeated.

In step S1, when the medium M on which a desired image is recorded in the printing device 2 is sent to the post-processing device 4 through the transport device 3, the controller 96 of the post-processing device 4 acquires the print data from the controller 15 of the printing device 2 and acquires the amount of ink ejected to the medium M in step S1. That is, the controller 96 of the post-processing device 4 acquires the amount of ink ejected to the first medium M4 based on the print data from the controller 15 of the printing device 2.

In step S1, the discharge tray 37 is placed at the second normal position P10.

In step S2, the controller 96 estimates the strength of the frictional force F acting on the second medium M5 from the first medium M4 based on the amount of ink ejected to the first medium M4. Specifically, the controller 96 estimates the strength of the frictional force F at a spot where the first medium M4 comes in contact with the second medium M5 based on the amount of ink ejected to the first medium M4 at the spot where the first medium M4 comes in contact with the second medium M5, and examines a possibility of the buckling on the second medium M5 in the discharge tray 37.

Further, when the frictional force F is weak at the spot where the first medium M4 comes in contact with the second medium M5, the controller 96 determines that the buckling hardly occurs in the second medium M5 in the discharge tray 37 (determined to be No). When the frictional force F is strong at the spot where the first medium M4 comes in contact with the second medium M5, the controller 96 determines that the buckling easily occurs in the second medium M5 in the discharge tray 37 (determined to be Yes).

When the controller 96 determines that the buckling hardly occurs in the second medium M5 in the discharge tray 37 (determined to be No) in step S2, step S14 is executed, the position of the discharge tray 37 is not moved, and the position of the discharge tray 37 is maintained at the second normal position P10.

When the discharge tray 37 is disposed at the second normal position P10 and the frictional force F is weak at the spot where the first medium M4 comes in contact with the second medium M5, the buckling does not occur in the second medium M5 in the discharge tray 37 at the second normal position P10.

When the controller 96 determines that the buckling easily occurs in the second medium M5 in the discharge tray 37 (determined to be Yes) in step S2, step S4 is executed. In step S4, the elevating mechanism 94 moves the discharge tray 37 to the second standby position P20 before the second medium M5 comes in contact with the first medium M4.

When the discharge tray 37 is disposed at the second standby position P20, the buckling hardly occurs in the second medium M5 in the discharge tray 37 at the second standby position P20 even when the frictional force F is strong at the position where the first medium M4 comes in contact with the second medium M5.

Further, in step S4, the controller 96 evaluates the degree of the influence of gravity using the parameter which influences the deformation due to the gravity. When the controller 96 determines that the second medium M5 is largely deformed in the gravity direction, the elevating mechanism 94 moves the discharge tray 37 in the +Z direction (direction opposite to the gravity direction) with respect to the second standby positions P20 before the second medium M5 comes in contact with the discharge tray 37 or the first medium M4 previously placed on the discharge tray 37 such that the buckling does not occur in the second medium M5 even when the influence of gravity is large. That is, the elevating mechanism 94 changes the second standby position of the discharge tray 37 according to the parameter which influences the deformation due to the gravity.

Furthermore, in step S4, when the A3 size second medium M5 is transported toward the intermediate tray 35, a state is made in which the front end E2 of the A3 size second medium M5 is placed on the outside of the discharge port 98. Then, at a stage before the A3 size second medium M5 is placed on the intermediate tray 35, the front end E2 of the A3 size second medium M5 comes in contact with the first medium M4 and the A3 size second medium M5, and thus there is a problem in that the front end E2 of the A3 size second medium M5 is deformed in the unintended direction on the discharge tray 37.

In this case, at the stage before the A3 size second medium M5 is placed on the intermediate tray 35, the elevating mechanism 94 moves the discharge tray 37 in the +Z direction and disposes the discharge tray 37 at the second standby position P20, such that the front end E2 of the A3 size second medium M5 is not deformed in the unintended direction on the discharge tray 37.

As above, when the front end E2 of the A3 size second medium M5 is placed on the outside of the discharge port 98 in a state in which the A3 size second medium M5 is placed on the intermediate tray 35, the elevating mechanism 94 moves the position of the discharge tray 37 in the +Z direction at the state before the A3 size second medium M5 is placed on the intermediate tray 35.

In step S7, when the discharge tray 37 moves from the second normal position P10 to the second standby position P20 in step S4, the controller 96 moves the discharge tray 37 from the second standby position P20 to the second normal position P10 until the rear end E1 of the second medium M5 is discharged from the discharge port 98 by the elevating mechanism 94. That is, the elevating mechanism 94 lowers the discharge tray 37 that is raised in the +Z direction to the original position (second normal position P10) until the rear end E1 of the second medium M5 is discharged from the discharge port 98.

A timing at which the discharge tray 37 moves from the second standby position P20 to the second normal position P10 is preferably after the front end E2 of the second medium M5 comes in contact with the first medium M4.

When the discharge tray 37 is disposed at the original position (second normal position P10), the medium pressing member 91 becomes rotatable, and thus the medium pressing member 91 can press the second medium M5 such that the second medium M5 placed on the discharge tray 37 does not float up from the discharge tray 37.

As above, in steps S2, S4, and S14, the possibility that the buckling occurs in the second medium M5 is examined, and the discharge tray 37 is moved in advance to a position (the second normal position P10 and the second standby position P20) where the buckling does not occur in the second medium M5 before the second medium M5 comes in contact with the first medium M4.

Specifically, the elevating mechanism 94 can move the discharge tray 37 to the second normal position P10 and the second standby position P20 positioned in the +Z direction with respect to the second normal position P10. When the frictional force F acting between the first medium M4 and the second medium M5 changes according to the amount of ink ejected to the first medium M4, the elevating mechanism 94 moves the discharge tray 37 to the second normal position P10 or the second standby position P20 according to the amount of ink ejected to the first medium M4 at the spot where the first medium M4 comes in contact with the second medium M5 before the first medium M4 comes in contact with the second medium M5.

With the configuration, the buckling hardly occurs in the second medium M5 in the discharge tray 37.

In addition, in the configuration according to the first embodiment, when the frictional force acting between the medium M (first medium) initially placed on the discharge tray 37 and the medium M (second medium) subsequently placed on the discharge tray 37 changes according to the amount of ink ejected to the medium M (first medium) initially placed on the discharge tray 37, it is preferable that the elevating mechanism 94 changes a height of the first standby position according to the amount of ink ejected to the first medium M (first medium) initially placed on the discharge tray 37 at the spot where the first medium M (first medium) initially placed on the discharge tray 37 comes in contact with the medium M (second medium) subsequently placed on the discharge tray 37.

Specifically, when the frictional force F is weak at the medium M (first medium) initially placed on the discharge tray 37 and at a spot where the medium M (first medium) initially placed on the discharge tray 37 comes in contact with the medium M (second medium) subsequently placed on the discharge tray 37 and when the discharge tray 37 is disposed at the first standby positions P1A and P1B, the buckling does not occur in the medium M (second medium). On the other hand, when the frictional force F is strong at the spot where the medium M (first medium) initially placed on the discharge tray 37 comes in contact with the medium M (second medium) subsequently placed on the discharge tray 37, there is a problem in that the buckling occurs in the medium M (second medium) subsequently placed on the discharge tray 37, and thus it is preferable to dispose the discharge tray 37 at a position (position in the +Z direction) higher than the first standby positions P1A and P1B, reduce the angle θ when coming in contact with the medium M (second medium) substantially placed on the discharge tray 37, and cause the buckling to hardly occurs in the medium M (second medium) substantially placed on the discharge tray 37.

With the configuration, when the medium M (the medium M1 which is hardly deformed, the medium M2 which is easily deformed, and the bundle M3 of mediums which are easier to be deformed), which is substantially placed on the discharge tray 37, comes in contact with the medium M which is initially placed on the discharge tray 37, the buckling hardly occurs in the medium M (the medium M1 which is hardly deformed, the medium M2 which is easily deformed, and the bundle M3 of mediums which are easier to be deformed), which is subsequently placed on the discharge tray 37, and the medium M (the medium M1 which is hardly deformed, the medium M2 which is easily deformed, and the bundle M3 of mediums which are easier to be deformed), which is subsequently placed on the discharge tray 37, is properly placed on the discharge tray 37.

3. First Modification Example

The medium M to which the ink is ejected includes a first region disposed on a downstream in the transport direction and a second region disposed on an upstream in the transport direction. Since the first region of the medium M easily affects the deformation of the medium M disposed on the outside of the discharge port 98, the elevating mechanism 94 may move the discharge tray 37 to the first normal position P1 or the first standby position P1A or P1B according to the amount of ink ejected to the first region in steps S4 and S14.

As above, in the modification example, the medium M is divided into the two regions including the first region and the second region, and the discharge tray 37 is moved to the first normal position P1 or the first standby position P1A or P1B by focusing on the region at which the medium M is easily deformed. Note that, the present disclosure is not limited to the medium M divided into two regions, and the medium M may be divided into a number of regions which is larger than two. For example, the medium M may be divided into four regions, or the medium M may be divided into six regions.

4. Second Modification Example

The present disclosure is not limited to a configuration in which the medium M is discharged to the outside from the discharge port 98 in the state of being nipped between the upper-side roller 42 and the lower-side roller 43. For example, a configuration may be provided in which, when the rear end E1 of the medium M is pressed in the transport direction, the medium M is discharged to the outside from the discharge port 98.

5. Third Modification Example

The present disclosure is not limited to a configuration in which the controller 15 of the printing device 2 controls the printing device 2 and the controller 96 of the post-processing device 4 controls the post-processing device 4. For example, a configuration may be provided in which the controller 15 of the printing device 2 controls the post-processing device 4 in addition to the printing device 2. For example, a configuration may be provided in which the controller 96 of the post-processing device 4 controls the printing device 2 in addition to the post-processing device 4. That is, a configuration may be provided in which the controller is provided in either the printing device 2 or the post-processing device 4.

Hereinafter, content derived from the embodiments will be described.

A post-processing device is a post-processing device configured to perform post processing on a medium on which recording is performed by a liquid ejecting portion, the post-processing device including an intermediate tray on which the medium transported in a transport direction is placed and aligned; a discharge port through which the medium post-processed on the intermediate tray is discharged; a discharge tray that is disposed in a gravity direction with respect to the discharge port and on which the medium discharged from the discharge port is placed; and an elevating mechanism that elevates the discharge tray, in which the elevating mechanism is configured to move the discharge tray to a first normal position and a first standby position positioned in a direction opposite to the gravity direction with respect to the first normal position, and to move the discharge tray to the first normal position or the first standby position according to an amount of liquid ejected from the liquid ejecting portion toward the medium before the medium comes in contact with the discharge tray or a medium previously placed on the discharge tray.

A rigidity of the medium changes according to the amount of liquid ejected from the liquid ejecting portion to the medium. For example, when a large amount of liquid is ejected to the medium and the amount of liquid (moisture) contained in the medium increases, the rigidity of the medium becomes small and the medium discharged from the discharge port is easily deformed in the gravity direction. For example, when a small amount of liquid is ejected to the medium and the amount of liquid (moisture) contained in the medium decreases, the rigidity of the medium increases and the medium discharged from the discharge port is less easily deformed in the gravity direction.

When the medium discharged from the discharge port is hardly deformed due to the large rigidity, the discharge tray is disposed at the first normal position. Further, the medium, which is hardly deformed due to the large rigidity, is properly placed on the discharge tray at the first normal position.

However, when the rigidity of the medium becomes small and the medium is easily deformed, the medium which is easily deformed is easily deformed in an unintended direction on the discharge tray at the first normal position, and thus there is a problem in that the medium cannot be properly placed on the discharge tray. Therefore, when the medium which is easily deformed due to the small rigidity is discharged to the discharge tray, the discharge tray is disposed at the first standby position which is positioned in the direction opposite to the gravity direction with respect to the first normal position.

When the discharge tray is disposed at the first standby position, a medium which is slightly deformed in the gravity direction is discharged to the discharge tray as compared with the case where the discharge tray is disposed at the first normal position. Then, as compared with the case where a medium which is largely deformed in the gravity direction is discharged to the discharge tray, the medium which is easily deformed is hardly deformed in the unintended direction on the discharge tray. As a result, the medium which is easily deformed is properly placed on the discharge tray at the first standby position.

In addition, when the elevating mechanism moves the position of the discharge tray before the medium comes in contact with the discharge tray or the medium previously placed on the discharge tray, and the medium, which is easily deformed due to the small rigidity, is discharged to the discharge tray at the first standby position, the medium, which is easily deformed due to the small rigidity, is properly placed on the discharge tray.

As above, in the post-processing device, when the elevating mechanism moves the discharge tray to a position suitable for each medium, either the medium, which is easily deformed due to the small rigidity, or the medium, which is hardly deformed due to the large rigidity, is properly placed on the discharge tray, and thus reliability obtained when the medium is placed on the discharge tray is improved.

In the post-processing device, it is preferable that the medium includes a first region disposed on a downstream in the transport direction and a second region disposed on an upstream in the transport direction, and the elevating mechanism moves the discharge tray to the first normal position or the first standby position according to the amount of liquid ejected to the first region.

The deformation of the medium discharged from the discharge port is easily influenced by the first region disposed on the downstream in the transport direction. Therefore, when the easiness of deformation of the medium in the first region is evaluated, the medium which is easily deformed is placed on the discharge tray at the first standby position, and the medium which is hardly deformed is placed on the discharge tray at the first normal position, both the medium which is easily deformed and the medium which is hardly deformed are properly placed on the discharge tray.

In the post-processing device, it is preferable that the elevating mechanism changes the first standby position or a second standby position of the discharge tray using a parameter which influences drying of the liquid in addition to the amount of liquid ejected from the liquid ejecting portion toward the medium, and the parameter which influences drying of the medium includes at least one of a temperature of an environment, a humidity of the environment, a transport speed of the medium transported in the transport direction, and a stop time of the medium transported in the transport direction.

Since the change in the rigidity of the medium and the easiness of deformation of the medium depend on the amount of liquid (moisture) contained in the medium, change is performed by the parameter that influences the drying of the medium in addition to the amount of liquid ejected from the liquid ejecting portion. Therefore, when the amount of liquid contained in the medium is predicted, while including the amount of liquid ejected from the liquid ejecting portion and the parameter which influences the drying of the liquid, and the easiness of deformation of the medium is predicted, the change in the rigidity of the medium and the easiness of deformation of the medium can be more properly predicted.

Then, the elevating mechanism easily moves the discharge tray to a more proper position in response to the change in the rigidity of the medium and the prediction of the easiness of deformation of the medium.

In the post-processing device, it is preferable that, when the medium includes a first medium that is initially placed on the discharge tray and a second medium that is subsequently placed on the discharge tray and a frictional force that acts between the first medium and the second medium changes according to the amount of liquid ejected to the first medium, the elevating mechanism changes a height of the first standby position according to the amount of liquid ejected to the first medium at a spot where the first medium comes in contact with the second medium.

The easiness of deformation of the second medium in the discharge tray changes according to the frictional force acting between the first medium and the second medium, in addition to the change in a rigidity of the second medium.

For example, when the amount of liquid ejected to the first medium is small and the frictional force acting between the first medium and the second medium is weak, the second medium is hardly deformed in an unintended direction on the discharge tray in a case where and the discharge tray is disposed at the first standby position.

However, when the amount of liquid ejected to the first medium is large and the frictional force acting between the first medium and the second medium is strong, the second medium is easily deformed in the unintended direction on the discharge tray even in a case where the discharge tray is disposed at the first standby position. In this case, when a height of the first standby position of the discharge tray is changed, the second medium is properly placed on the discharge tray.

Therefore, it is preferable to change the height of the first standby position according to the amount of liquid ejected to the first medium at a spot where the first medium comes in contact with the second medium.

A post-processing device is a post-processing device configured to perform post processing on a medium on which recording is performed by a liquid ejecting portion, the post-processing device including an intermediate tray on which the medium transported in a transport direction is placed, a discharge port through which the medium post-processed on the intermediate tray is discharged, a discharge tray that is disposed in a gravity direction with respect to the discharge port and on which the medium discharged from the discharge port is placed, and an elevating mechanism that elevates the discharge tray, in which the elevating mechanism is configured to move the discharge tray to a second normal position and a second standby position positioned in a direction opposite to the gravity direction with respect to the second normal position, and in which, when the medium includes a first medium that is initially placed on the discharge tray and a second medium that is subsequently placed on the discharge tray and a frictional force that acts between the first medium and the second medium changes according to an amount of liquid ejected to the first medium, the elevating mechanism moves the discharge tray to the second normal position or the second standby position according to the amount of liquid ejected to the first medium at a spot where the first medium comes in contact with the second medium before the second medium comes in contact with the first medium.

When the frictional force acting between the first medium and the second medium changes according to the amount of liquid ejected to the first medium, easiness of deformation of the second medium changes in the discharge tray is changed according to the amount of liquid ejected to the first medium from the liquid ejecting portion. For example, when a large amount of liquid is ejected to the first medium and the amount of liquid (moisture) contained in the first medium increases, the frictional force acting between the first medium and the second medium becomes strong, with the result that the second medium hardly slides on the first medium, and thus the second medium is easily deformed. For example, when a small amount of liquid is ejected to the first medium and the amount of liquid (moisture) contained in the first medium decreases, the frictional force acting between the first medium and the second medium becomes weak, with the result that the second medium easily slides on the first medium, and thus the second medium is hardly deformed.

When the second medium is hardly deformed, the discharge tray is disposed at the second normal position, and the second medium is properly placed on the discharge tray at the second normal position.

However, when the second medium is easily deformed and the discharge tray is disposed at the second normal position, unintended deformation easily occurs in the second medium on the discharge tray, and thus there is a problem in that the second medium is not properly placed on the discharge tray at the second normal position.

Therefore, when the second medium is easily deformed by the frictional force acting between the first medium and the second medium, the discharge tray is positioned at the second standby position positioned in the direction opposite to the gravity direction with respect to the second normal position, and the second medium, which is easily deformed, is placed on the discharge tray at the second standby position.

When the discharge tray is disposed at the second standby position, the angle formed by the second medium and the discharge tray becomes small as compared with the discharge tray is disposed at the second normal position, and, even when a strong frictional force acts between the first medium and the second medium, the second medium, which is easily deformed, is hardly deformed in the unintended direction on the discharge tray. As a result, the second medium, which is easily deformed, is properly placed on the discharge tray at the second standby position.

Therefore, when the elevating mechanism moves the position of the discharge tray before the second medium comes in contact with the first medium, such that the second medium, which is easily deformed by the frictional force acting between the first medium and the second medium, is discharged to the discharge tray at the second standby position, the second medium which is easily deformed is properly placed on the discharge tray at the second standby position.

In addition, when the elevating mechanism moves the position of the discharge tray before the second medium comes in contact with the first medium, such that the second medium, which is hardly deformed by the frictional force acting between the first medium and the second medium, is discharged to the discharge tray at the second normal position, the second medium, which is hardly deformed, is properly placed on the discharge tray at the second normal position.

Accordingly, even when the second medium is easily deformed by the frictional force acting between the first medium and the second medium, or when the second medium is hardly deformed, each second medium is properly placed on the discharge tray in such a way that the elevating mechanism moves the discharge tray to a position suitable for each second medium.

As above, in the post-processing device, for either the second medium which is easily deformed or the second medium which is hardly deformed, the second medium is properly placed on the discharge tray, the reliability obtained when the medium is placed on the discharge tray is improved.

In the post-processing device, it is preferable that the liquid ejecting portion ejects the liquid to the medium based on print data, and the amount of liquid ejected from the liquid ejecting portion toward the medium is acquired based on the print data.

Since the print data includes the amount of liquid ejected to a print region of the medium, it is preferably that the amount of liquid is obtained based on the print data.

In the post-processing device, it is preferable that the elevating mechanism changes the first standby position or a second standby position of the discharge tray using a parameters which influences deformation of the medium due to gravity in addition to the amount of liquid ejected from the liquid ejecting portion toward the medium, and the parameter which influences the deformation of the medium due to the gravity includes at least one of a length of the medium in the transport direction and the number of mediums to be post-processed on the intermediate tray.

The easiness of deformation of the medium discharged from the discharge port changes according to a parameter which influences the deformation of the medium due to the gravity, in addition to the amount of liquid ejected from the liquid ejecting portion. When the easiness of deformation of the medium discharged from the discharge port is predicted while including the parameter which influences the deformation of the medium due to the gravity, in addition to the amount of liquid ejected from the liquid ejecting portion, the easiness of deformation of the medium discharged from the discharge port can be more properly predicted.

Then, the elevating mechanism easily moves the discharge tray to a more proper position according to the easiness of deformation of the medium discharged from the discharge port.

In the post-processing device, it is preferable that, when a downstream end of the medium in the transport direction is disposed on an outside of the discharge port in a state in which the medium is placed on the intermediate tray, the elevating mechanism moves a position of the discharge tray in the opposite direction at a stage before the medium is placed on the intermediate tray.

When the downstream end of the medium in the transport direction is disposed on the outside of the discharge port in a state in which the medium is placed on the intermediate tray, the downstream end of the medium in the transport direction comes in contact with the discharge tray at a stage before the medium is placed on the intermediate tray, and thus there is a problem in that the medium is deformed in the unintended direction.

When the downstream end of the medium in the transport direction comes in contact with the discharge tray at the stage before the medium is placed on the intermediate tray and the elevating mechanism moves the position of the discharge tray in the opposite direction at the stage before the medium is placed on the intermediate tray, the medium is hardly deformed in the unintended direction in a case where the downstream end of the medium in the transport direction comes in contact with the discharge tray.

In the post-processing device, it is preferable that the elevating mechanism lowers the discharge tray that is raised in the opposite direction to an original position until an upstream end of the medium in the transport direction is discharged from the discharge port.

The original position is the first normal position or the second normal position, and is disposed to be separated from the discharge port disposed in the gravity direction with respect to the first standby position or the second standby position. Therefore, when the discharge tray is disposed at the original position (the first normal position or the second normal position), the discharge tray is disposed to be separated from the discharge port as compared with the case where the discharge tray is disposed at the first standby position or the second standby position. Then, when the next medium which is easily deformed is discharged from the discharge port, a space for receiving the next medium which is easily deformed is secured, and the next medium which is easily deformed is easily and properly discharged to the discharge tray.

The printing system includes a printing device including a liquid ejecting portion which ejects a liquid to a medium, and the post-processing device.

Since reliability of the post-processing device is enhanced when the medium is placed on the discharge tray, reliability of the printing system including the post-processing device is also enhanced.

What is claimed is:

1. A post-processing device configured to perform post processing on a medium on which recording is performed by a liquid ejecting portion, the post-processing device comprising:

an intermediate tray on which the medium transported in a transport direction is placed and aligned;

a discharge port through which the medium post-processed on the intermediate tray is discharged;

a discharge tray that is disposed in a gravity direction with respect to the discharge port and on which the medium discharged from the discharge port is placed; and an elevating mechanism configured to elevate the discharge tray, wherein the elevating mechanism to configured to move the discharge tray to a first normal position and a first standby position positioned in a direction opposite to the gravity direction with respect to the first normal position, the elevating mechanism is configured to move the discharge tray before the medium comes in contact with the discharge tray or a medium previously placed on the discharge tray, to the first normal position when a first medium which is hardly deformed is discharged to the discharge tray and to the first standby position when a second medium which is easier deformed than the first medium, and the elevating mechanism is configured to move the discharge tray to the first normal position or the first standby position according to a number of the mediums to be post-processed on the intermediate tray.

2. The post-processing device according to claim 1, wherein a rigidity of the second medium is smaller than a rigidity of the first medium.

3. The post-processing device according to claim 1, wherein the medium includes a first region disposed on a downstream in the transport direction and a second region disposed on an upstream in the transport direction, and the elevating mechanism moves the discharge tray to the first normal position or the first standby position according to an amount of liquid ejected to the first region.

4. The post-processing device according to claim 1, wherein the elevating mechanism changes the first standby position or a second standby position of the discharge tray using a parameter which influences drying of the liquid, and the parameter which influences drying of the medium includes at least one of a temperature of an environment, a humidity of the environment, a transport speed of the medium transported in the transport direction, and a stop time of the medium transported in the transport direction.

5. The post-processing device according to claim 1, wherein when the medium includes a third medium that is initially placed on the discharge tray and a fourth medium that is subsequently placed on the discharge tray and a frictional force that acts between the third medium and the fourth medium changes according to an amount of liquid ejected to the third medium, the elevating mechanism changes a height of the first standby position according to the amount of liquid ejected to the third medium at a spot where the third medium comes in contact with the fourth medium.

6. The post-processing device according to claim 1, wherein the liquid ejecting portion ejects the liquid to the medium based on print data, and the amount of liquid ejected from the liquid ejecting portion toward the medium is acquired based on the print data.

7. The post-processing device according to claim 6, wherein the elevating mechanism changes the first standby position or a second standby position of the discharge tray using a parameter which influences deformation of the medium due to gravity in addition to the amount of liquid ejected from the liquid ejecting portion toward the medium, and the parameter which influences the deformation of the medium due to the gravity includes at least one of a length of the medium in the transport direction and the number of the mediums to be post-processed on the intermediate tray.

8. The post-processing device according to claim 1, wherein the elevating mechanism lowers the discharge tray that is raised in the opposite direction to an original position until an upstream end of the medium in the transport direction is discharged from the discharge port.

9. The post-processing device according to claim 1, wherein when a downstream end of the medium in the transport direction is disposed on an outside of the discharge port in a state in which the medium is placed on the intermediate tray, the elevating mechanism moves a position of the discharge tray in the opposite direction at a stage before the medium is placed on the intermediate tray.

10. A printing system comprising:

a printing device including a liquid ejecting portion which ejects a liquid to a medium; and the post-processing device according to claim 1.

11. A post-processing device configured to perform post processing on a medium on which recording is performed by a liquid ejecting portion, the post-processing device comprising:

an intermediate tray on which the medium transported in a transport direction is placed and aligned;

a discharge port through which the medium post-processed on the intermediate tray is discharged;

a discharge tray that is disposed in a gravity direction with respect to the discharge port and on which the medium discharged from the discharge port is placed; and an elevating mechanism configured to elevate the discharge tray, wherein the elevating mechanism is configured to move the discharge tray to a first normal position and a first standby position positioned in a direction opposite to the gravity direction with respect to the first normal position, the elevating mechanism is configured to move the discharge tray before the medium comes in contact with the discharge tray or a medium previously placed on the discharge tray, to the first normal position when a first medium which is hardly deformed is discharged to the discharge tray and to the first standby position when a second medium which is easier deformed than the first medium, and when the medium includes a third medium that is initially placed on the discharge tray and a fourth medium that is subsequently placed on the discharge tray and a frictional force that acts between the third medium and the fourth medium changes according to an amount of liquid ejected to the third medium, the elevating mechanism changes a height of the first standby position according to the amount of liquid ejected to the third medium at a spot where the third medium comes in contact with the fourth medium.

12. A post-processing device configured to perform post processing on a medium on which recording is performed by a liquid ejecting portion, the post-processing device comprising:

an intermediate tray on which the medium transported in a transport direction is placed and aligned;

a discharge port through which the medium post-processed on the intermediate tray is discharged;

a discharge tray that is disposed in a gravity direction with respect to the discharge port and on which the medium discharged from the discharge port is placed; and an elevating mechanism configured to elevate the discharge tray, wherein the elevating mechanism is configured to move the discharge tray to a first normal position and a first standby position positioned in a direction opposite to the gravity direction with respect to the first normal position, the elevating mechanism is configured to move the discharge tray before the medium comes in contact with the discharge tray or a medium previously placed on the discharge tray, to the first normal position when a first medium which is hardly deformed is discharged to the discharge tray and to the first standby position when a second medium which is easier deformed than the first medium, and when a downstream end of the medium in the transport direction is disposed on an outside of the discharge port in a state in which the medium is placed on the intermediate tray, the elevating mechanism moves a position of the discharge tray in the opposite direction at a stage before the medium is placed on the intermediate tray.

* * * * *